US011805580B2

(12) United States Patent
Han et al.

(10) Patent No.: US 11,805,580 B2
(45) Date of Patent: Oct. 31, 2023

(54) LED DRIVING DEVICE AND LIGHTING DEVICE INCLUDING THE SAME

(71) Applicant: SAMSUNG ELECTRONICS CO., LTD., Suwon-si (KR)

(72) Inventors: Deokhee Han, Osan-si (KR); Sangcheol Bong, Seoul (KR); Hyunjung Kim, Yongin-si (KR); Jongkwan Lee, Seoul (KR); June Jang, Seoul (KR); Minsoo Han, Hwaseong-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 0 days.

(21) Appl. No.: 17/942,689

(22) Filed: Sep. 12, 2022

(65) Prior Publication Data

US 2023/0171858 A1 Jun. 1, 2023

(30) Foreign Application Priority Data

Nov. 29, 2021 (KR) ..... 10-2021-0167054

(51) Int. Cl.
*H05B 45/325* (2020.01)
*H05B 45/10* (2020.01)
*H05B 45/46* (2020.01)

(52) U.S. Cl.
CPC ..... *H05B 45/10* (2020.01); *H05B 45/325* (2020.01); *H05B 45/46* (2020.01)

(58) Field of Classification Search
CPC ..... H05B 45/10; H05B 45/32; H05B 45/325; H05B 45/46; H05B 47/10
See application file for complete search history.

(56) References Cited

U.S. PATENT DOCUMENTS 6,372,608 B1 4/2002 Shimoda et al.
6,645,830 B2 11/2003 Shimoda et al.
(Continued)

FOREIGN PATENT DOCUMENTS

JP 2011-054964 A 3/2011
KR 10-2216934 B1 2/2021
KR 10-2222014 B1 3/2021

OTHER PUBLICATIONS

Communication dated Jun. 26, 2023, issued by the German Patent Office in German Application No. 102022126500.5.

*Primary Examiner* — Jimmy T Vu
(74) *Attorney, Agent, or Firm* — Sughrue Mion, PLLC

(57) ABSTRACT

A light emitting diode (LED) driving device is provided. The LED driving device includes a rectifier configured to generate a rectified voltage, wherein the rectifier is directly connected to an input node of a light source including LEDs; a regulator configured to output a direct current (DC) power supply voltage using the rectified voltage; a microcontroller including a control terminal and a power terminal, wherein the microcontroller is configured to generate a dimming control signal based on a voltage input, receive the DC power supply voltage through the power terminal and output the dimming control signal through the control terminal; a driver configured to control an LED current to flow through the LEDs based on the dimming control signal; and a switch connected between a control node and a ground node, wherein an output terminal of the regulator and the control terminal are connected to the control node.

20 Claims, 26 Drawing Sheets

(56) References Cited

U.S. PATENT DOCUMENTS

| | | | |
|---|---|---|---|
| RE38,466 | E | 3/2004 | Inoue et al. |
| 6,818,465 | B2 | 11/2004 | Biwa et al. |
| 6,818,530 | B2 | 11/2004 | Shimoda et al. |
| 6,858,081 | B2 | 2/2005 | Biwa et al. |
| 6,967,353 | B2 | 11/2005 | Suzuki et al. |
| 7,002,182 | B2 | 2/2006 | Okuyama et al. |
| 7,084,420 | B2 | 8/2006 | Kim et al. |
| 7,087,932 | B2 | 8/2006 | Okuyama et al. |
| 7,154,124 | B2 | 12/2006 | Han et al. |
| 7,208,725 | B2 | 4/2007 | Sherrer et al. |
| 7,288,758 | B2 | 10/2007 | Sherrer et al. |
| 7,319,044 | B2 | 1/2008 | Han et al. |
| 7,501,656 | B2 | 3/2009 | Han et al. |
| 7,709,857 | B2 | 5/2010 | Kim et al. |
| 7,759,140 | B2 | 7/2010 | Lee et al. |
| 7,781,727 | B2 | 8/2010 | Sherrer et al. |
| 7,790,482 | B2 | 9/2010 | Han et al. |
| 7,964,881 | B2 | 1/2011 | Choi et al. |
| 7,940,350 | B2 | 5/2011 | Jeong |
| 7,959,312 | B2 | 6/2011 | Yoo et al. |
| 7,985,976 | B2 | 7/2011 | Choi et al. |
| 7,994,525 | B2 | 8/2011 | Lee et al. |
| 8,008,683 | B2 | 8/2011 | Choi et al. |
| 8,013,352 | B2 | 9/2011 | Lee et al. |
| 8,049,161 | B2 | 11/2011 | Sherrer et al. |
| 8,129,711 | B2 | 3/2012 | Kang et al. |
| 8,179,938 | B2 | 5/2012 | Kim |
| 8,263,987 | B2 | 9/2012 | Choi et al. |
| 8,324,646 | B2 | 12/2012 | Lee et al. |
| 8,399,944 | B2 | 3/2013 | Kwak et al. |
| 8,432,511 | B2 | 4/2013 | Jeong |
| 8,459,832 | B2 | 6/2013 | Kim |
| 8,502,242 | B2 | 8/2013 | Kim |
| 8,536,604 | B2 | 9/2013 | Kwak et al. |
| 8,735,931 | B2 | 5/2014 | Han et al. |
| 8,766,295 | B2 | 7/2014 | Kim |
| 9,125,258 | B2 | 9/2015 | Lee |
| 10,292,217 | B2 * | 5/2019 | Zhu ..... H05B 45/385 |
| 10,531,534 | B1 | 1/2020 | Zhou |
| 10,874,001 | B2 | 12/2020 | Lee et al. |
| 10,874,008 | B2 | 12/2020 | Qiu et al. |
| 2011/0050110 | A1 | 3/2011 | Han |
| 2014/0300285 | A1 | 10/2014 | Medak |
| 2015/0341995 | A1 | 11/2015 | Lu et al. |
| 2021/0195707 | A1 | 6/2021 | Han et al. |

* cited by examiner

LED DRIVING DEVICE AND LIGHTING DEVICE INCLUDING THE SAME

CROSS-REFERENCE TO RELATED APPLICATION

This application claims priority to Korean Patent Application No. 10-2021-0167054, filed on Nov. 29, 2021 in the Korean Intellectual Property Office, the disclosure of which is incorporated by reference herein in its entirety.

BACKGROUND

The present disclosure relates to a light emitting device (LED) driving device and a lighting device including the same.

LEDs have advantages such as low power consumption and a long lifespan, and are rapidly replacing existing fluorescent and incandescent lamps. Recently, various types of lighting devices employing LEDs as light sources have been developed and commercialized, and research into lighting devices having various functions in addition to the simple lighting function is also being actively conducted. For example, the lighting device may support a function of controlling the color temperature of light as well as brightness of light.

SUMMARY

Example embodiments provide an LED driving device capable of operating an LED using an alternating current (AC) voltage without a converter circuit and providing a dimming function and a color temperature control function for controlling the brightness of light, and a lighting device including the same.

According to an aspect of an example embodiment, an LED driving device includes: a rectifier configured to rectify alternating current (AC) power to generate a rectified voltage, wherein the rectifier is directly connected to an input node of a light source including a plurality of LEDs; a regulator configured to output a direct current (DC) power supply voltage using the rectified voltage; a microcontroller including a control terminal and a power terminal, wherein the microcontroller is configured to generate a dimming control signal based on a voltage input, receive the DC power supply voltage through the power terminal and output the dimming control signal through the control terminal; a driver configured to control an LED current to flow through the plurality of LEDs based on the dimming control signal; and a switch connected between a control node and a ground node, wherein an output terminal of the regulator and the control terminal are connected to the control node.

According to an aspect of an example embodiment, a lighting device includes: a rectifier configured to rectify AC power to output a rectified voltage; a regulator configured to output a DC power supply voltage, using the rectified voltage; a first LED string including a plurality of first LEDs configured to output light of a first color temperature, wherein the first LED string is connected to an output terminal of the rectifier; a second LED string including a plurality of second LEDs configured to output light of a second color temperature, wherein the second LED string is connected to the output terminal of the rectifier, and the first LED string in parallel; a microcontroller including a control terminal, wherein the microcontroller is configured to generate a first dimming control signal and a second dimming control signal, based on a voltage input to the control terminal and the DC power supply voltage; a first driver configured to control a first LED current to flow through the first LED string, based on the first dimming control signal; a second driver configured to control a second LED current to flow through the second LED string, based on the second dimming control signal; and a control circuit configured to generate a control signal based on an input, and to output the control signal to the control terminal.

According to an aspect of an example embodiment, a lighting device includes: a rectifier configured to rectify alternating current (AC) power and output a rectified voltage; a regulator configured to output a direct current (DC) power supply voltage using the rectified voltage; a first LED string including a plurality of first LEDs configured to output light having a first color temperature, wherein the first LED string is connected to an output terminal of the rectifier; a second LED string including a plurality of second LEDs configured to output light having a second color temperature, wherein the second LED string is connected to the output terminal of the rectifier, and the first LED string in parallel; a microcontroller including a control terminal, wherein the microcontroller is configured to generate a first dimming control signal and a second dimming control signal based on the DC power supply voltage and any one or any combination of a voltage level and a waveform of a control signal input to the control terminal; a first driver configured to control brightness of the first LED string based on the first dimming control signal; and a second driver configured to control brightness of the second LED string based on the second dimming control signal. The microcontroller includes an internal memory, and is configured to adjust the first dimming control signal and the second dimming control signal based on a history of the control signal stored in the internal memory.

BRIEF DESCRIPTION OF DRAWINGS

The above and other aspects will become more apparent from the following description of example embodiments, taken in conjunction with the accompanying drawings, in which.

DETAILED DESCRIPTION

Hereinafter, example embodiments will be described in detail with reference to the accompanying drawings. Each example embodiment is not excluded from being associated with one or more features of another example or another example embodiment also provided herein or not provided herein but consistent with the present disclosure. It will be understood that when an element or layer is referred to as being "on," "connected to" or "coupled to" another element or layer, it can be directly on, connected or coupled to the other element or layer, or intervening elements or layers may be present. By contrast, when an element is referred to as being "directly on," "directly connected to" or "directly coupled to" another element or layer, there are no intervening elements or layers present. Expressions such as "at least one of," when preceding a list of elements, modify the entire list of elements and do not modify the individual elements of the list. For example, the expression, "at least one of a, b, and c," should be understood as including only a, only b, only c, both a and b, both a and c, both b and c, or all of a, b, and c.

Figure 1:
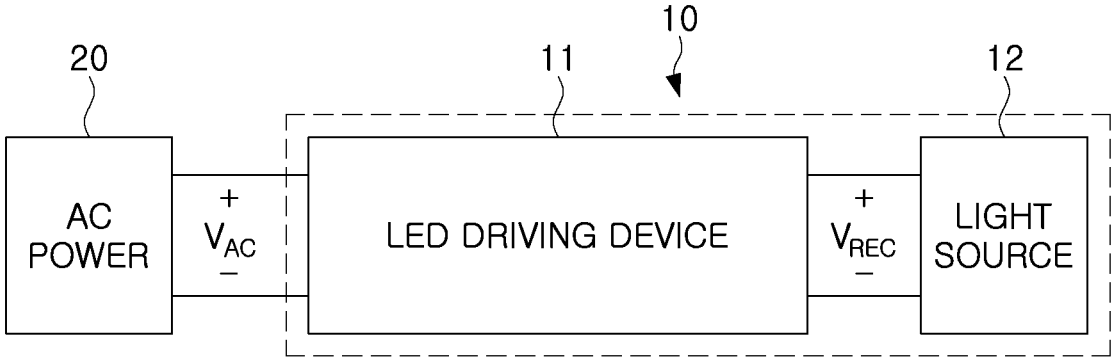
FIG. 1 is a block diagram schematically illustrating a lighting device according to an example embodiment.

FIG. 1 is a block diagram schematically illustrating a lighting device according to an example embodiment.

Referring to FIG. 1, a lighting device 10 according to an example embodiment may operate based on power provided by AC power supply 20, and may include an LED driving device 11 and a light source 12 for outputting light. For example, the LED driving device 11 may rectify an AC voltage $V_{AC}$ output from the AC power supply 20 to output the rectified voltage $V_{REC}$. The rectified voltage $V_{REC}$ may be directly input to the LEDs included in the light source 12. Accordingly, the LED driving device 11 may not include a converter circuit that outputs a constant current for driving the light source 12 using the AC voltage ($V_{AC}$).

In an example embodiment, the light source 12 may include at least one LED string. The LED driving device 11 may provide the rectified voltage $V_{REC}$ to the input terminal of the LED string, and may include an AC driver connected to the output terminal of the LED string. When the light source 12 includes a plurality of LED strings connected to each other in parallel, the LED driving device 11 may include a plurality of AC drivers connected to the plurality of LED strings, respectively. Accordingly, the LED driving device 11 may individually control the LED current flowing through the respective LED strings.

When the light source 12 includes a plurality of LED strings, at least some of the plurality of LED strings may output light of different color temperatures. For example, the first LED string may output light of a first color temperature, and the second LED string may output light of a second color temperature different from the first color temperature. In an example embodiment, the light of the first color temperature may be a warm white series light, and the light of the second color temperature may be a cool white series light.

As described above, because the LED driving device 11 may individually control the LED current flowing through each of the LED strings, the lighting device 10 may provide a function of adjusting the color temperature of light together with a dimming function of adjusting the brightness of light. In addition, according to the color of the light output from each of the LED strings, the lighting device 10 may be controlled to output light of various colors in addition to the white-based light.

Figure 2:
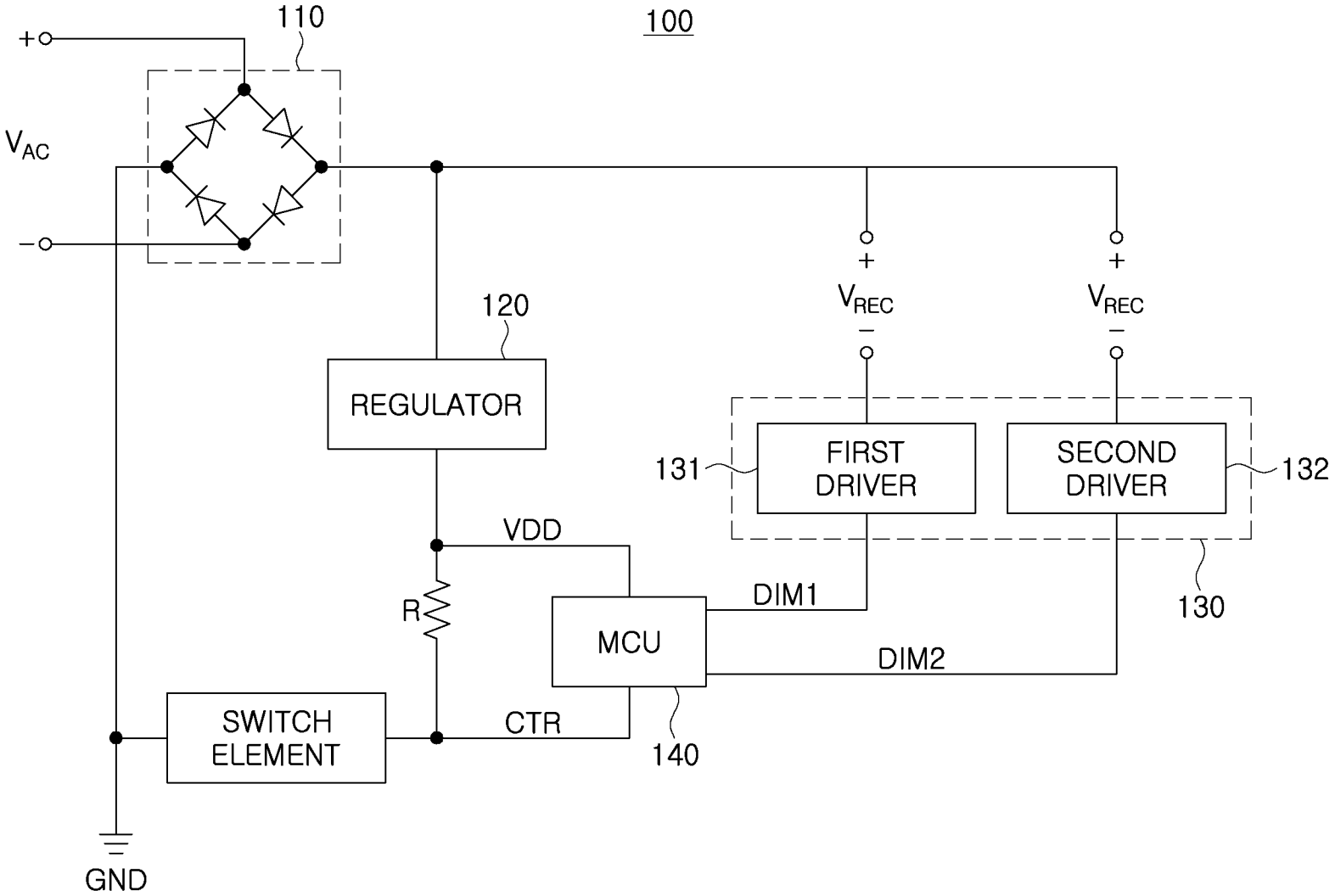
FIG. 2 is a diagram schematically illustrating an LED driving device according to an example embodiment.

FIG. 2 is a diagram schematically illustrating an LED driving device according to an example embodiment.

Referring to FIG. 2, an LED driving device 100 according to an example embodiment may include a rectifier 110, a regulator 120, a driving unit 130, a microcontroller 140, a switch element 150, and the like. The rectifier 110 may include a diode bridge circuit and may rectify the AC voltage $V_{AC}$ to output the rectified voltage $V_{REC}$. A node through which the rectifier 110 outputs the rectified voltage $V_{REC}$ may be directly connected to a plurality of LEDs included in the light source, as well as the regulator 120.

The regulator 120 generates a power supply voltage VDD by using the rectified voltage $V_{REC}$, and the microcontroller 140 may operate by the power supply voltage VDD output from the regulator 120. The microcontroller 140 may control LED currents $I_{LED1}$ and $I_{LED2}$ flowing through the light source by outputting at least one dimming control signal DIM1 and DIM2 to the driving unit 130.

In the example embodiment illustrated in FIG. 2, the driving unit 130 may include a first driver 131 and a second driver 132, and the first driver 131 and the second driver 132 may be respectively connected to LED strings connected to each other in parallel in the light source. The first driver 131 may adjust the first LED current $I_{LED1}$ based on the first dimming control signal DIM1, and the second driver 132 may adjust the second LED current $I_{LED2}$ based on the second dimming control signal DIM2. Accordingly, the microcontroller 140 may individually adjust the brightness of each of the LED strings included in the light source.

In an example embodiment, each of the first dimming control signal DIM1 and the second dimming control signal DIM2 may be a pulse width modulation (PWM) signal. The microcontroller 140 may change the duty ratio of each of the first dimming control signal DIM1 and the second dimming control signal DIM2 according to the control signal CTR, and thus, may increase/decrease each of the first LED current ($I_{LED1}$) and the second LED current ($I_{LED2}$).

Also, in an example embodiment, each of the first dimming control signal DIM1 and the second dimming control signal DIM2 may be an analog voltage signal. The first driver 131 may control the first LED current $I_{LED1}$ according to a voltage level of the first dimming control signal DIM1, and the second driver 132 may control the second LED current $I_{LED2}$ according to a voltage level of the second dimming control signal DIM2. The voltage level of the first dimming control signal DIM1 and the voltage level of the second dimming control signal DIM2 may be controlled by the microcontroller 140.

In the example embodiment illustrated in FIG. 2, the control terminal through which the microcontroller 140 receives the control signal CTR may be connected to a node between the switch element 150 and a resistor R. The node between the switch element 150 and the resistor R may be referred to as a control node, and thus the switch element 150 may be connected between the control node and the ground node GND. The resistor R may be connected to a node through which the regulator 120 outputs the power voltage VDD. For example, the switch element 150 may include a switch that may be directly manipulated, for example by a user, in a space where a light source connected to the LED driving device 100 is installed, for example, a contact switch.

A lighting device using an LED as a light source may include a converter circuit that generates a constant current suitable for driving the LED by using an alternating voltage ($V_{AC}$). However, the converter circuit requires space, and therefore increases the size the LED driving device in the lighting device. Thus, it may be difficult to adopt the LED driving device including the converter circuit due to the increased size of the lighting device. On the other hand, as illustrated in FIG. 2, the LED driving device 100 according to an example embodiment may directly drive the LED with the rectified voltage $V_{REC}$ output from the rectifier 110 without a separate converter circuit, may therefore have a reduced size, and may thus be the space inside the lighting device.

In addition, only one switch element 150 is needed to implement an on/off switching function and a dimming function. Therefore, in an example embodiment, a TRIAC dimmer, or the like, may be omitted. Thus, production cost may be reduced. In an example embodiment, the waveform of the control signal (CTR) input to the microcontroller 140 may be changed according to the on/off switching of the switch element 150, and the microcontroller 140 may differently control the first driver 131 and the second driver 132 according to the waveform of the control signal CTR. Accordingly, with only the switch element 150, on/off switching, dimming functions and color temperature control functions may be implemented.

For example, on/off switching of the switch element 150, may control the voltage level of the control signal CTR input to the microcontroller 140 to be changed. The microcontroller 140 may receive the control signal CTR, and adjust each of the first dimming control signal DIM1 and the second dimming control signal DIM2 according to the voltage level. Hereinafter, with reference to FIGS. 3A and 3B, the operation of the microcontroller 140 according to the on/off switching of the switch element 150 will be described in more detail.

Figure 3A:
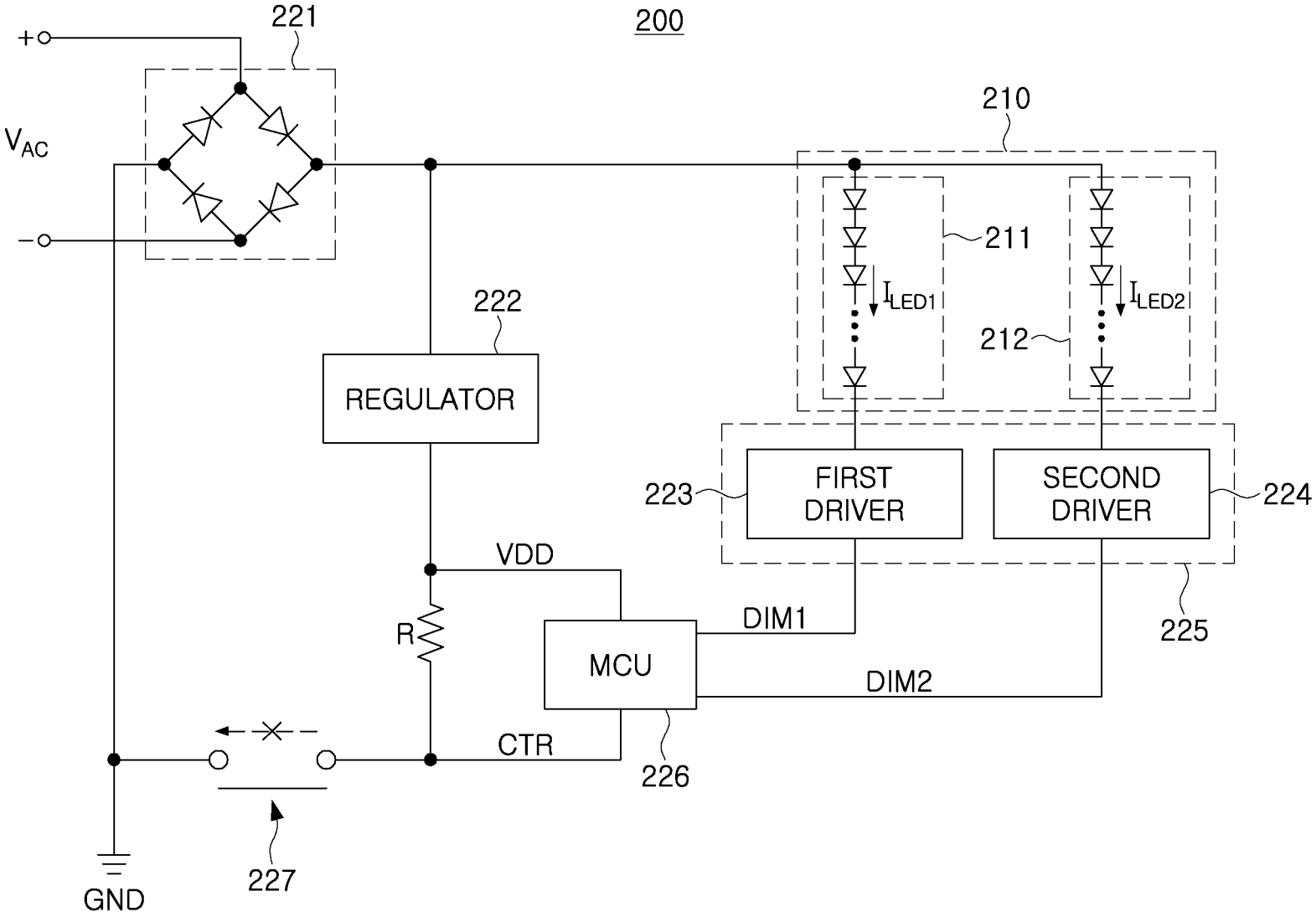
FIGS. 3A and 3B are diagrams illustrating operation of a lighting device according to example embodiments.
Figure 3B:
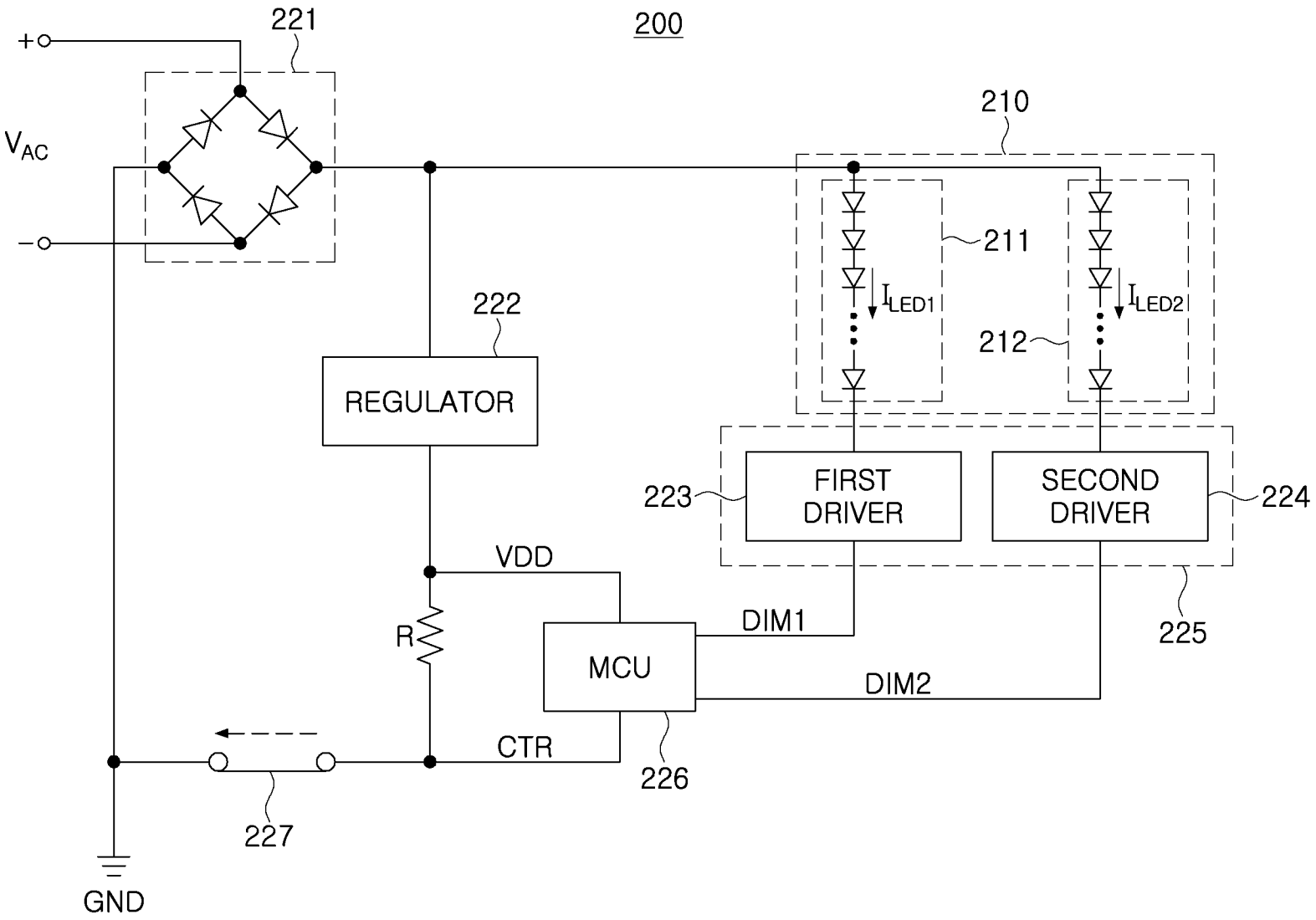

FIGS. 3A and 3B are diagrams illustrating operation of a lighting device according to example embodiments.

Referring to FIGS. 3A and 3B, a lighting device 200 according to an example embodiment may include a light source 210 and an LED driving device. The LED driving device may include a rectifier 221, a regulator 222, a driving unit 225, a microcontroller 226, and a switch element 227. In the example embodiment illustrated in FIGS. 3A and 3B, the switch element 227 may be implemented as a contact switch that may be directly operated by a user.

The light source 210 includes at least one LED string, and as illustrated in FIGS. 3A and 3B, the light source 210 may include a first LED string 211 and a second LED string 212 connected to each other in parallel. The first LED string 211 may include a plurality of first LEDs connected to each other in series, and the second LED string 212 may include a plurality of second LEDs connected to each other in series. For example, the plurality of first LEDs may output light of a first color temperature, and the plurality of second LEDs may output light of a second color temperature different from the first color temperature.

The first LED string 211 may be connected to the first driver 223 of the driving unit 225, and the second LED string 212 may be connected to the second driver 224 of the driving unit 225. The first driver 223 may adjust the first LED current $I_{LED1}$ flowing through the first LED string 211 according to the first dimming control signal DIM1 output from the microcontroller 226, and the second driver 224 may adjust the second LED current $I_{LED2}$ flowing through the second LED string 212 according to the second dimming control signal DIM2 output from the microcontroller 226.

The microcontroller 226 may include a control terminal which receives a control signal CTR, and the control terminal may be connected to the switch element 227. As illustrated in FIG. 3A, when the switch element 227 is turned off, the control terminal of the microcontroller 226 may be separated from the ground node GND. Accordingly, a high level voltage similar to the power supply voltage VDD output by the regulator 222 may be input as a control signal CTR to the control terminal.

On the other hand, when the switch element 227 is turned on as illustrated in FIG. 3B, the control terminal of the microcontroller 226 may be connected to the ground node GND through the switch element 227. Accordingly, a low level voltage similar to the ground voltage may be input as a control signal CTR to the control terminal. As such, the voltage level of the control signal CTR input to the control terminal of the microcontroller 226 may vary according to the state of the switch element 227.

The microcontroller 226 may be configured to change the first dimming control signal DIM1 and the second dimming control signal DIM2 according to the voltage level of the control signal CTR. Accordingly, the voltage level of the control signal CTR input to the microcontroller 226 may be controlled by turning the switch element 227 on/off. Furthermore, the brightness and/or the color temperature of the light output from the light source 210 may be controlled by turning the switch element 227 on/off.

In addition, in an example embodiment, the microcontroller 226 may be configured to differently adjust the first dimming control signal DIM1 and the second dimming control signal DIM2 according to various patterns in which the voltage level of the control signal CTR changes. For example, when the switch element 227 is briefly turned on once and then maintains the turn-off state for a predetermined time, the microcontroller 226 may increase the brightness of the first LED string 211 and decrease the brightness of the second LED string 212 to change the color temperature of the light output from the light source 210 to be close to the first color temperature. When the switch element 227 is briefly turned on once again, the microcontroller 226 may decrease the brightness of the first LED string 211 and increase the brightness of the second LED string 212, and the color temperature of the light output from the light source 210 may be adjusted to be close to the second color temperature.

For example, when the switch element 227 is turned on twice in succession, the microcontroller 226 may simultaneously increase the duty ratios of the first dimming control signal DIM1 and the second dimming control signal DIM2 to increase the brightness of the light output from the light source 210. Also, in an example embodiment, when the switch element 227 is turned on once for a long time, the microcontroller 226 may simultaneously reduce the duty ratios of the first dimming control signal DIM1 and the second dimming control signal DIM2, thereby reducing the brightness of the light output by the light source 210.

In summary, the microcontroller 226 may be configured to respectively control the first dimming control signal DIM1 and the second dimming control signal DIM2 according to the operation of the switch element 227. How the first dimming control signal DIM1 and the second dimming control signal DIM2 are controlled by the operation of the switch element 227 may vary depending on the setting of the microcontroller 226, and the examples described above may be some of the various operating scenarios that the microcontroller 226 may support. Accordingly, in an example embodiment, the LED driving device having a simple structure and may support both the dimming function for controlling the brightness of light and the function for adjusting the color temperature of light.

Figure 4:
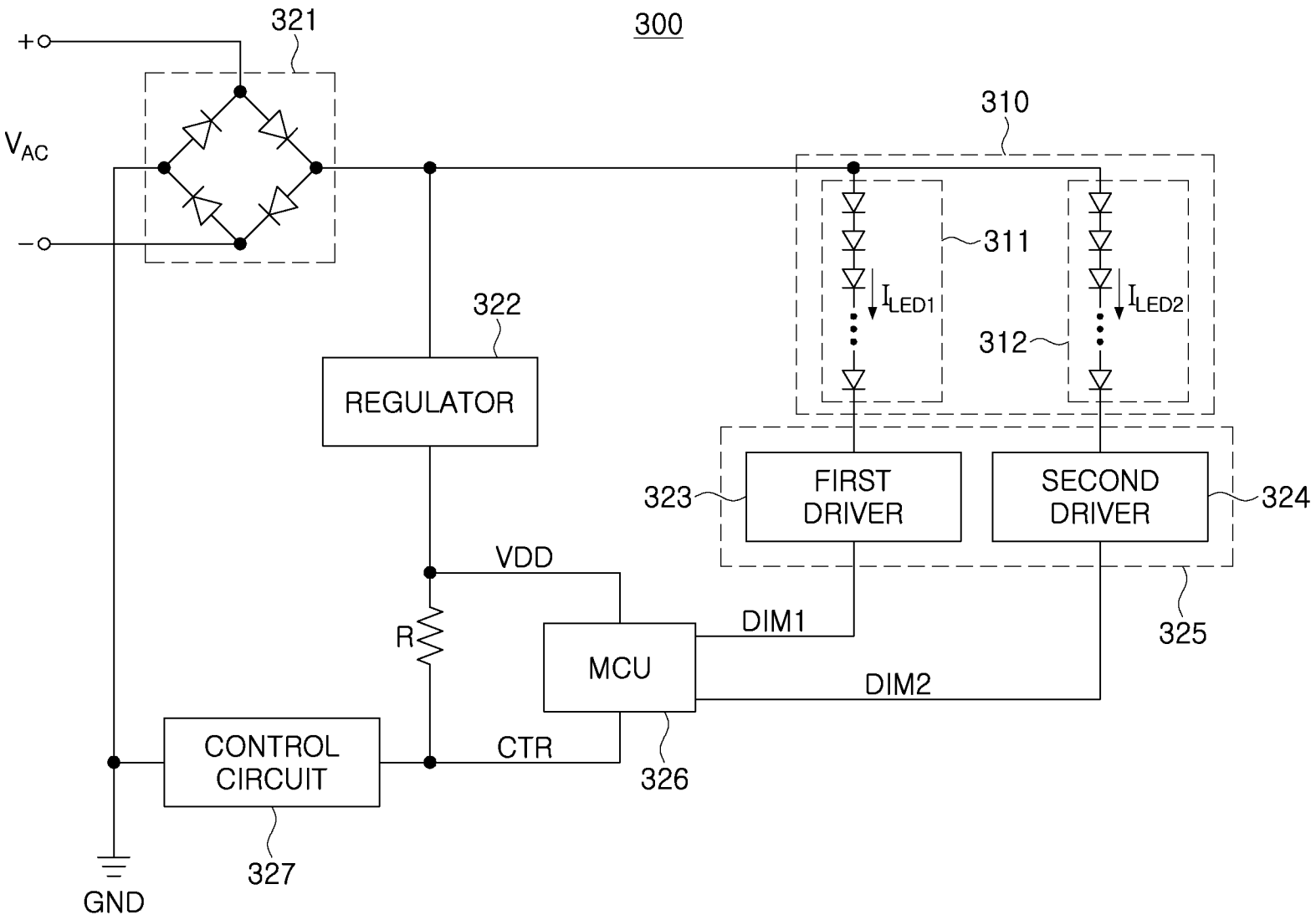
FIG. 4 is a diagram schematically illustrating a lighting device according to an example embodiment.

FIG. 4 is a diagram schematically illustrating a lighting device according to an example embodiment.

Referring to FIG. 4, a lighting device 300 according to an example embodiment may include a light source 310 and an LED driving device. The LED driving device may include a rectifier 321, a regulator 322, a driving unit 325, a microcontroller 326, and a control circuit 327.

The configurations of the light source 310 and the LED driving device may be similar to those of the example embodiment described above with reference to FIGS. 3A and 3B. The light source 310 may include a first LED string 311 and a second LED string 312 connected to each other in parallel. The first LED string 311 may include a plurality of first LEDs that output light of a first color temperature, and the second LED string 312 may include a plurality of second LEDs that output light of a second color temperature.

The first LED current $I_{LED1}$ flowing through the first LED string 311 may be adjusted by the first driver 323, and the second LED current $I_{LED2}$ flowing through the second LED string 312 may be controlled by the second driver 324. The first driver 323 may adjust the first LED current $I_{LED1}$ according to a duty ratio of the first dimming control signal DIM1 received from the microcontroller 326, and the second driver 324 may adjust the second LED current $I_{LED2}$ according to a duty ratio of the second dimming control signal DIM2 received from the microcontroller 326.

In the example embodiment illustrated in FIG. 4, in the microcontroller 326, a control terminal receiving the control signal CTR may be connected to the control circuit 327 rather than the switch element. In an example embodiment, the control circuit 327 may generate and output the control signal CTR according to various input signals generated by an input panel based on manipulation of the input panel. The microcontroller 326 may be configured to adjust the brightness and/or color temperature of the light output from the light source 310 according to the control signal CTR generated based on the manipulation of the input panel connected to the control circuit 327, according to the control signal CTR received from the control circuit 327.

For example, when an input for lowering the brightness of the light output from the light source 310 is provided on the input panel, the control circuit 327 may output the control signal CTR corresponding to the selected input to the microcontroller 326. When receiving the control signal CTR corresponding to the brightness reduction input, the microcontroller 326 may be configured to reduce the respective duty ratios of the first dimming control signal DIM1 and the second dimming control signal DIM2 together.

When an input that changes the color temperature of the light output from the light source 310 is selected on the input panel to be close to the second color temperature, the control circuit 327 may output the control signal CTR corresponding to the selected input to the microcontroller 326. The microcontroller 326 may be configured to decrease the duty ratio of the first dimming control signal DIM1 and increase the duty ratio of the second dimming control signal DIM2, according to the control signal CTR received from the control circuit 327.

The control circuit 327 may output the control signal CTR having various waveforms and voltage levels to the microcontroller 326, unlike the contact switch described above. For example, the control circuit 327 may output a control signal CTR having a voltage level that linearly increases or decreases to the microcontroller 326 according to an input manipulated on the input panel. Also, the control circuit 327 may output a control signal CTR having different frequencies or duty ratios to the microcontroller 326 according to an input manipulated on the input panel.

Figure 5A:
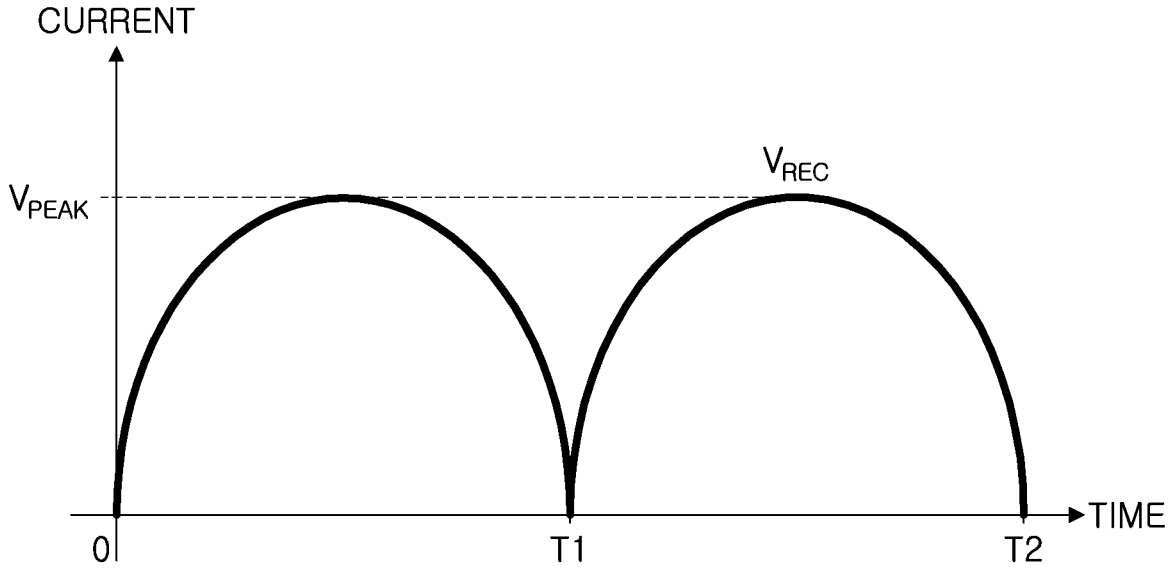
FIGS. 5A, 5B and 5C are diagrams illustrating operation of an LED driving device according to an example embodiment.
Figure 5B:
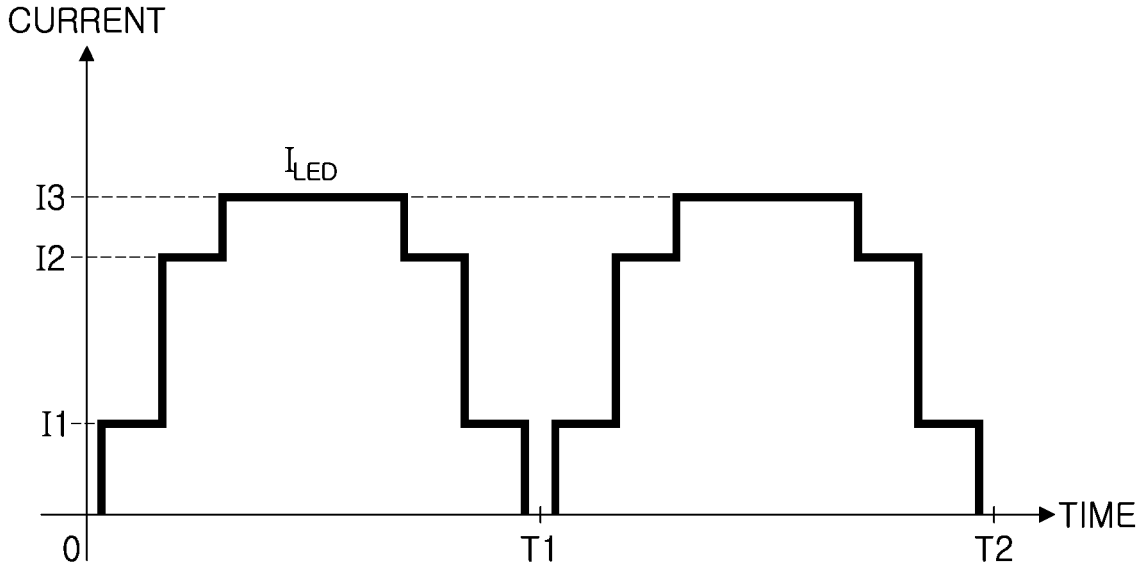
Figure 5C:
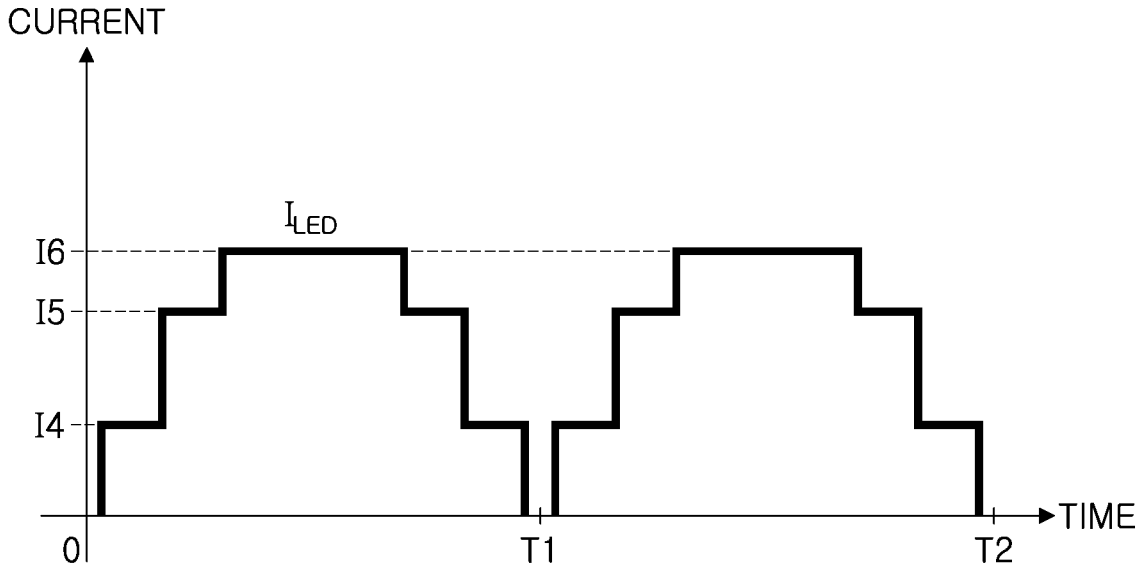

FIGS. 5A, 5B and 5C are diagrams illustrating operation of an LED driving device according to an example embodiment.

FIG. 5A is a diagram illustrating a waveform of a rectified voltage $V_{REC}$ input to a light source in an LED driving device according to an example embodiment. Referring to FIG. 5A, the LED driving device converts both halves of each cycle of an AC voltage to generate a rectified voltage $V_{REC}$, and a voltage level of the rectified voltage $V_{REC}$ may increase and decrease in each period. The rectified voltage $V_{REC}$ may have a peak voltage $V_{PEAK}$ within one cycle.

Next, FIGS. 5B and 5C are diagrams illustrating waveforms of LED currents ($I_{LED}$) flowing through a plurality of LEDs included in a light source under the control of the LED driving device according to an example embodiment. Although the example embodiments illustrated in FIGS. 5B and 5C illustrate that the LED current $I_{LED}$ is divided into a plurality of steps within one cycle of the rectified voltage $V_{REC}$, example embodiments are not limited thereto and the LED current $I_{LED}$ may have only one step within one cycle of the rectified voltage $V_{REC}$.

In an example embodiment, as illustrated in FIG. 5B, the LED current ($I_{LED}$) may have a first current I1, a second current I2, a third current I3, a second current I2, and a first current I1 sequentially within one cycle of rectified voltage $V_{REC}$. Next, in the example embodiment illustrated in FIG. 5C, the LED current $I_{LED}$ may have a fourth current I4, a fifth current I5, a sixth current I6, a fifth current I5, and a fourth current I4 sequentially, within one cycle of the rectified voltage $V_{REC}$.

The first current I1 may be greater than the fourth current I4, the second current I2 may be greater than the fifth current I5, and the third current I3 may be greater than the sixth current I6. Accordingly, when the LED current $I_{LED}$ according to the example embodiment illustrated in FIG. 5B is supplied, the brightness of the light output by a plurality of LEDs may be brighter than the brightness of the light output by the plurality of LEDs when the LED current ($I_{LED}$) according to the example embodiment illustrated in FIG. 5C is supplied.

In an example embodiment, by controlling the duty ratio of the dimming control signal output to the driver by the microcontroller included in the LED driving device, the LED current ($I_{LED}$) may be adjusted. For example, when an input to increase brightness using a switch element or a control circuit is received, the microcontroller may increase the duty ratio of the dimming control signal based on the control signal received from the switch element or the control circuit. In an example embodiment, as the duty ratio of the dimming control signal increases, the LED current $I_{LED}$ may increase.

Also, as described above, the LED driving device according to an example embodiment may be connected to a plurality of LED strings that output light of different color temperatures. As an example, the microcontroller of the LED driving device may adjust the LED current ($I_{LED}$) flowing in the first LED string as in the example embodiment illustrated in FIG. 5B, and may adjust the LED current ($I_{LED}$) flowing through the second LED string as in the example embodiment illustrated in FIG. 5C, based on the control signal generated according to the received input. In this case, the color temperature of the light output by the light source may be changed close to the color temperature of the light output by the first LED string.

FIGS. 6A, 6B, 6C and 6D are diagrams illustrating a driver included in an LED driving device according to an example embodiment.

Referring to FIGS. 6A, 6B, 6C and 6D, the driver 330 according to an example embodiment is connected to nodes corresponding to cathodes of one or more of a plurality of LEDs (LED1-LED3) included in an LED string, and the number of LEDs that are actually turned on among the plurality of LEDs LED1-LED3 may be controlled. Because the plurality of LEDs (LED1-LED3) operate by receiving the rectified voltage ($V_{REC}$), as described above with reference to FIGS. 5A to 5C, it is necessary to control the current flowing through the plurality of LEDs (LED1-LED3).

Figure 6A:
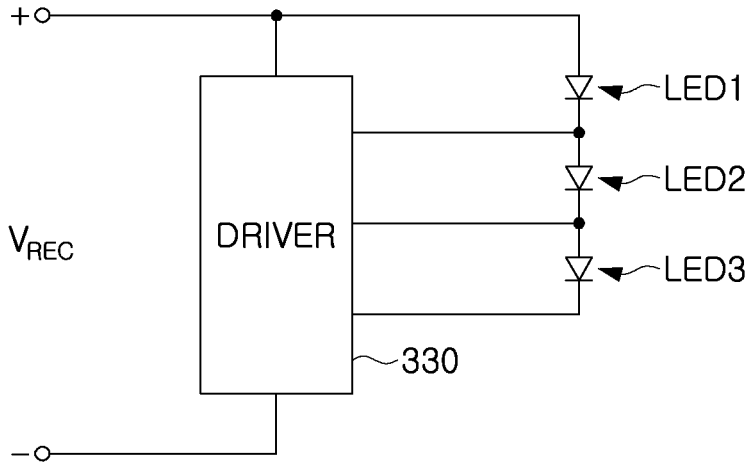
FIGS. 6A, 6B, 6C and 6D are diagrams illustrating a driver included in an LED driving device according to an example embodiment.
Figure 6B:
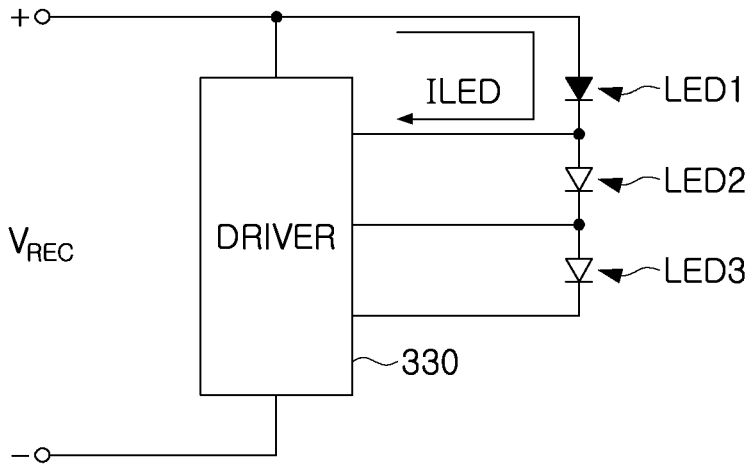

Referring to FIG. 6B first, for a first time when the rectified voltage $V_{REC}$ is lower than the first reference voltage, the magnitude of the rectified voltage $V_{REC}$ may not provide a forward voltage sufficient to turn on all of the plurality of LEDs LED1-LED3. For example, the forward voltage may be capable of turning on one LED. Therefore, the driver 330 may control the path of the LED current $I_{LED}$ so that only the first LED LED1 is turned on, as illustrated in FIG. 6B. For example, the LED current $I_{LED}$ in the example embodiment illustrated in FIG. 6B may be the first current I1 in the example embodiment illustrated in FIG. 5B or may be the fourth current I4 in the example embodiment illustrated in FIG. 5C.

Figure 6C:
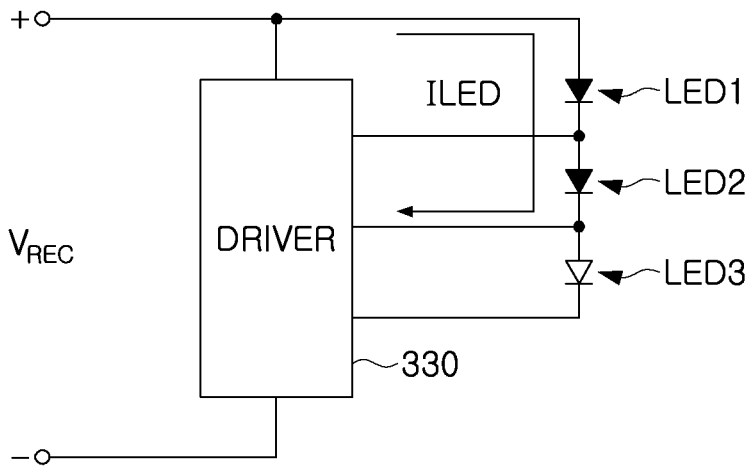

Next, referring to FIG. 6C, during a second time period different from the first time period, the magnitude of the rectified voltage $V_{REC}$ may provide a forward voltage capable of turning on two LEDs. Accordingly, the driver 330 may change the path of the LED current $I_{LED}$ so that the first LED (LED1) and the second LED (LED2) are turned on. In the example embodiment illustrated in FIG. 6C, the LED current $I_{LED}$ may be the second current I2 in the example embodiment illustrated in FIG. 5B or may be the fifth current I5 in the example embodiment illustrated in FIG. 5C.

Figure 6D:
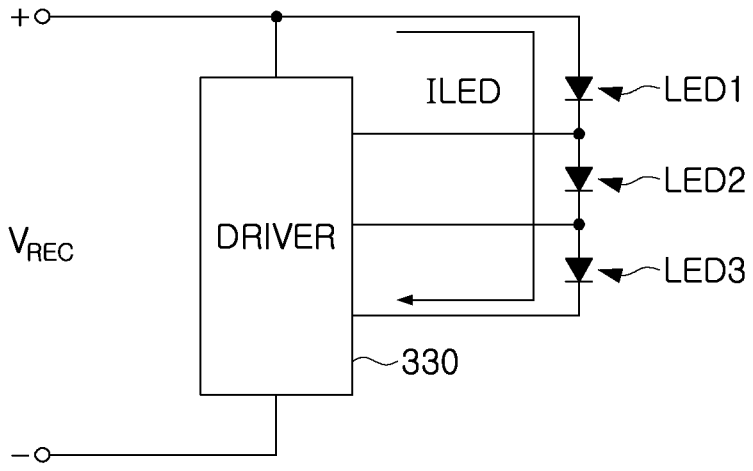

Referring to FIG. 6D, during a third time period different from the second time period, the magnitude of the rectified voltage $V_{REC}$ may provide a sufficient forward voltage to turn on all of the plurality of LEDs LED1-LED3. Accordingly, the driver 330 may change the path of the LED current $I_{LED}$ such that the first LED (LED1), the second LED (LED2), and the third LED (LED3) are all turned on. In the example embodiment illustrated in FIG. 6D, the LED current $I_{LED}$ may be the third current I3 in the example embodiment illustrated in FIG. 5B or may be the sixth current I6 in the example embodiment illustrated in FIG. 5C.

The driver 330 may include switches connected to the nodes corresponding to the cathodes of the one or more LEDs of the plurality of LEDs LED1-LED3. For example, the driver 330 according to the example embodiment illustrated in FIGS. 6A to 6D may include at least three switches. The driver 330 controls the on/off switching of the switch to control the path of the LED current ($I_{LED}$) as described with reference to FIGS. 6B to 6D, and may drive a plurality of LEDs (LED1-LED3) in an AC direct drive method. For example, to control the LED current $I_{LED}$ to pass through only the first LED (LED1), the driver 330 may close a first switch corresponding to the cathode of the first LED (LED1), and open second and third switches corresponding to cathodes of the second LED (LED2) and the third LED (LED3). For example, to control the LED current $I_{LED}$ to pass through the first LED (LED1) and the second LED (LED2), the driver 330 may close the second switch corresponding to the cathode of the second LED2, and open the first and third switches corresponding to cathodes of the first LED (LED1) and the third LED (LED3). For example, to control the LED current $I_{LED}$ to pass through each of the first LED (LED1), the second LED (LED2) and the third LED (LED3), the driver 330 may close the third switch corresponding to the cathode of the third LED3, and open the first and second switches corresponding to cathodes of the first LED (LED1) and the second LED (LED2).

In an example embodiment, the driver 330 may adjust the magnitude of the LED current $I_{LED}$ flowing through the plurality of LEDs LED1-LED3 according to the dimming control signal output by the microcontroller, thereby providing a dimming function. In addition, by inputting different dimming control signals to the driver 330 connected to each of the LED strings having different color temperatures, a function to adjust the color temperature of the entire lighting may be implemented, which will be described below with reference to FIG. 7.

Figure 7:
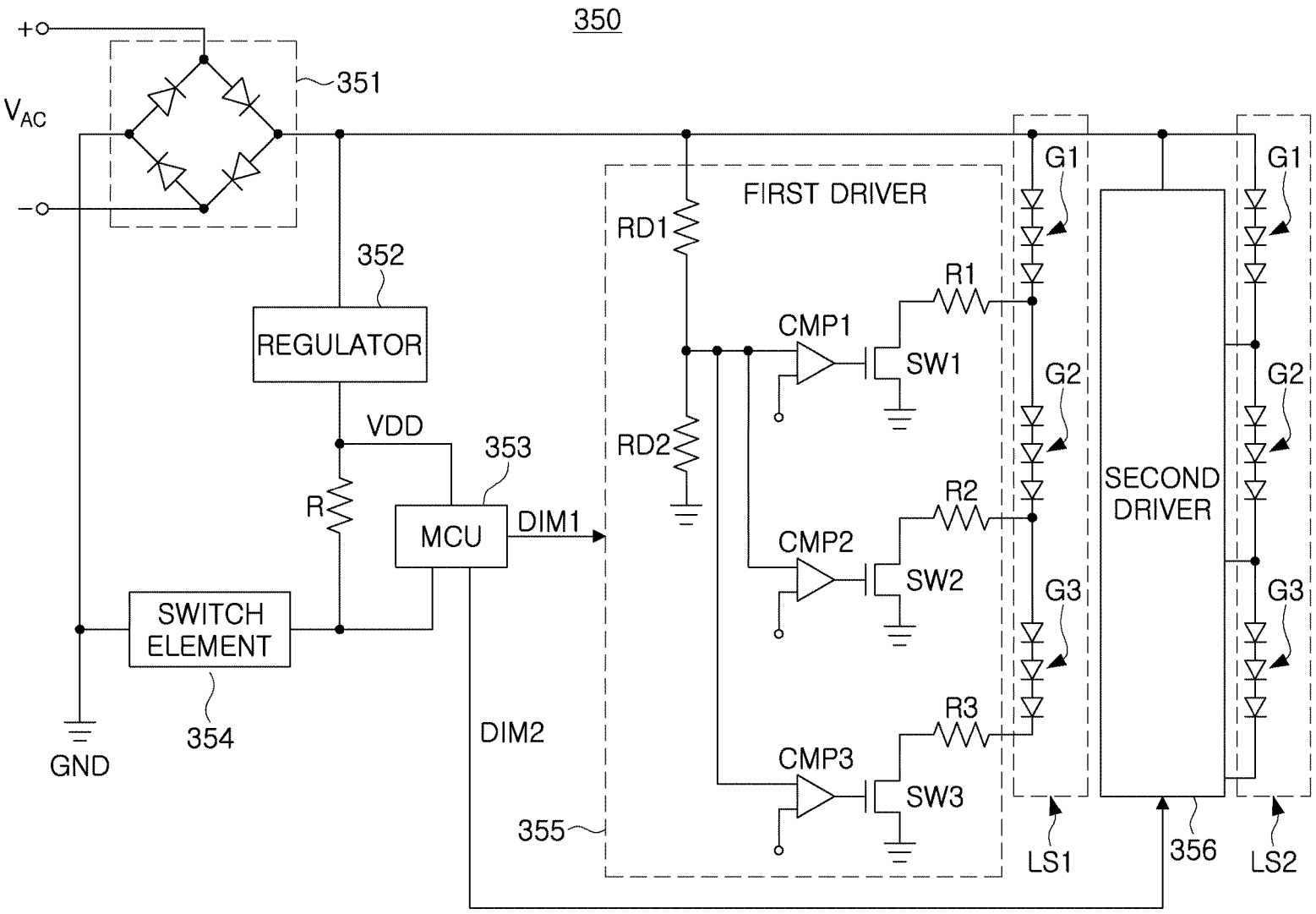
FIG. 7 is a diagram illustrating an LED driving device according to an example embodiment.

FIG. 7 is a diagram illustrating an LED driving device according to an example embodiment.

Referring to FIG. 7, the LED driving device 350 according to an example embodiment may include a rectifier 351 for rectifying AC power ($V_{AC}$), a regulator 352, a microcontroller 353, a switch element 354, first and second drivers 355 and 356, and the like. In the example embodiment illustrated in FIG. 7, the switch element 354 may be implemented as a contact switch that may be directly manipulated by a user. However, as described above, the switch element 354 may be replaced with a control circuit communicably coupled with a control panel or the like.

The LED driving device 350 may be connected to a light source including the first LED string LS1 and the second LED string LS2. The first LED string LS1 may include a plurality of first LEDs connected to each other in series, and the second LED string LS2 may include a plurality of second LEDs connected to each other in series. For example, the plurality of first LEDs may output light of a first color temperature, and the plurality of second LEDs may output light of a second color temperature different from the first color temperature.

Each of the first LED string LS1 and the second LED string LS2 may include a plurality of LED groups G1-G3, and each of the plurality of LED groups G1-G3 may include at least one LED. Although FIG. 7 illustrates an example embodiment in which each of the first LED string LS1 and the second LED string LS2 includes three LED groups G1-G3, and each of the LED groups G1-G3 includes three LEDs, example embodiments are not limited thereto.

Operations of the drivers 355 and 356 will be described with reference to the first driver 355. The first driver 355 may include a plurality of switches SW1-SW3, and each of the plurality of switches SW1-SW3 may be connected to a node corresponding to an output terminal of the LED groups G1-G3. For example, the third switch SW3 may be connected to the output terminal of the first LED string LS1. The plurality of switches SW1-SW3 may be connected to the LED groups G1-G3 through the plurality of resistors R1-R3.

On/off switching of each of the plurality of switches SW1-SW3 may be controlled by the comparators CMP1-CMP3. Each of the comparators CMP1-CMP3 has a first input terminal, a second input terminal, and an output terminal. For example, the output terminal may be connected to one control terminal of the plurality of switches SW1-SW3, for example, a gate terminal. A first input terminal of each of the comparators CMP1-CMP3 may be connected to a node between a first division resistor RD1 and a second division resistor RD2, and may receive a voltage corresponding to the rectified voltage output by the rectifier 351.

On the other hand, the magnitude of the voltage input to the second input terminal of each of the comparators CMP1-CMP3 may vary according to the first dimming control signal DIM1 input to the first driver 355. The brightness of the first LED string LS1 may be adjusted by changing the magnitude of the voltage input to the second input terminal of each of the comparators CMP1-CMP3 using the first dimming control signal DIM1. The second driver 356 may have the same structure as the first driver 355, and may receive the second dimming control signal DIM2. Accordingly, the brightness of the second LED string LS2 may be controlled by the second dimming control signal DIM2.

Figure 8:
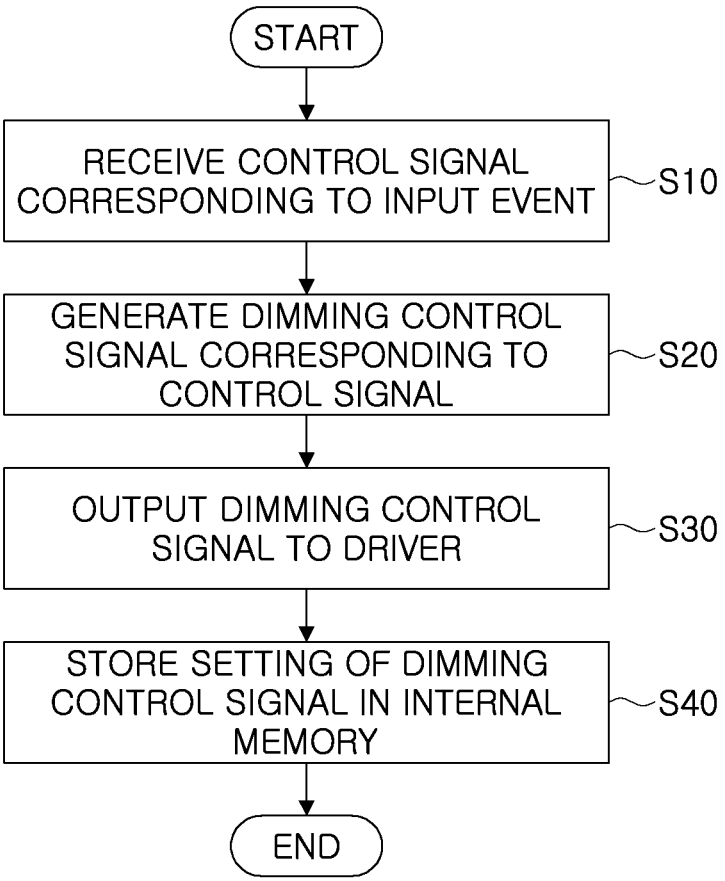
FIGS. 8 to 10 are diagrams illustrating operation of an LED driving device according to example embodiments.
Figure 9:
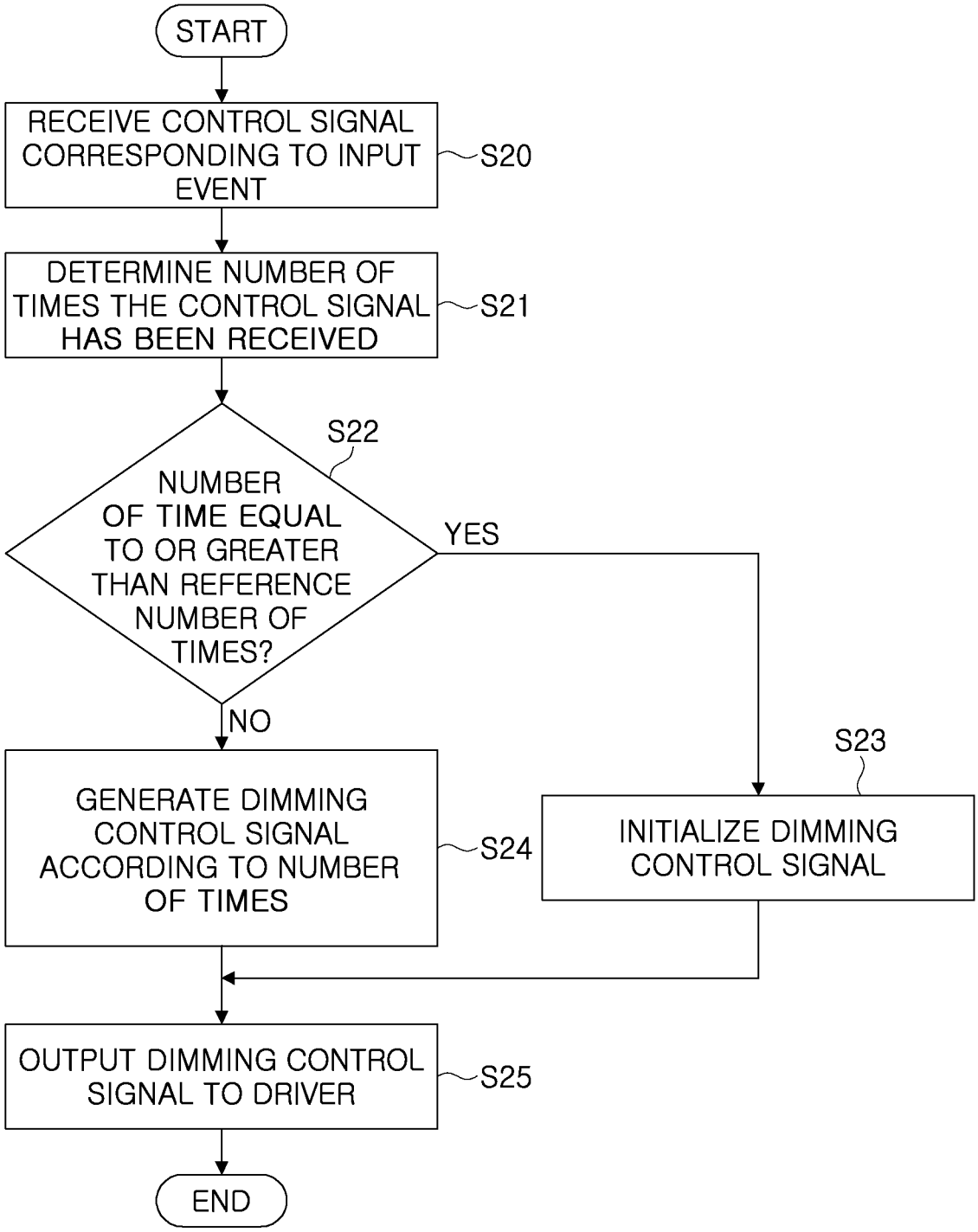
Figure 10:
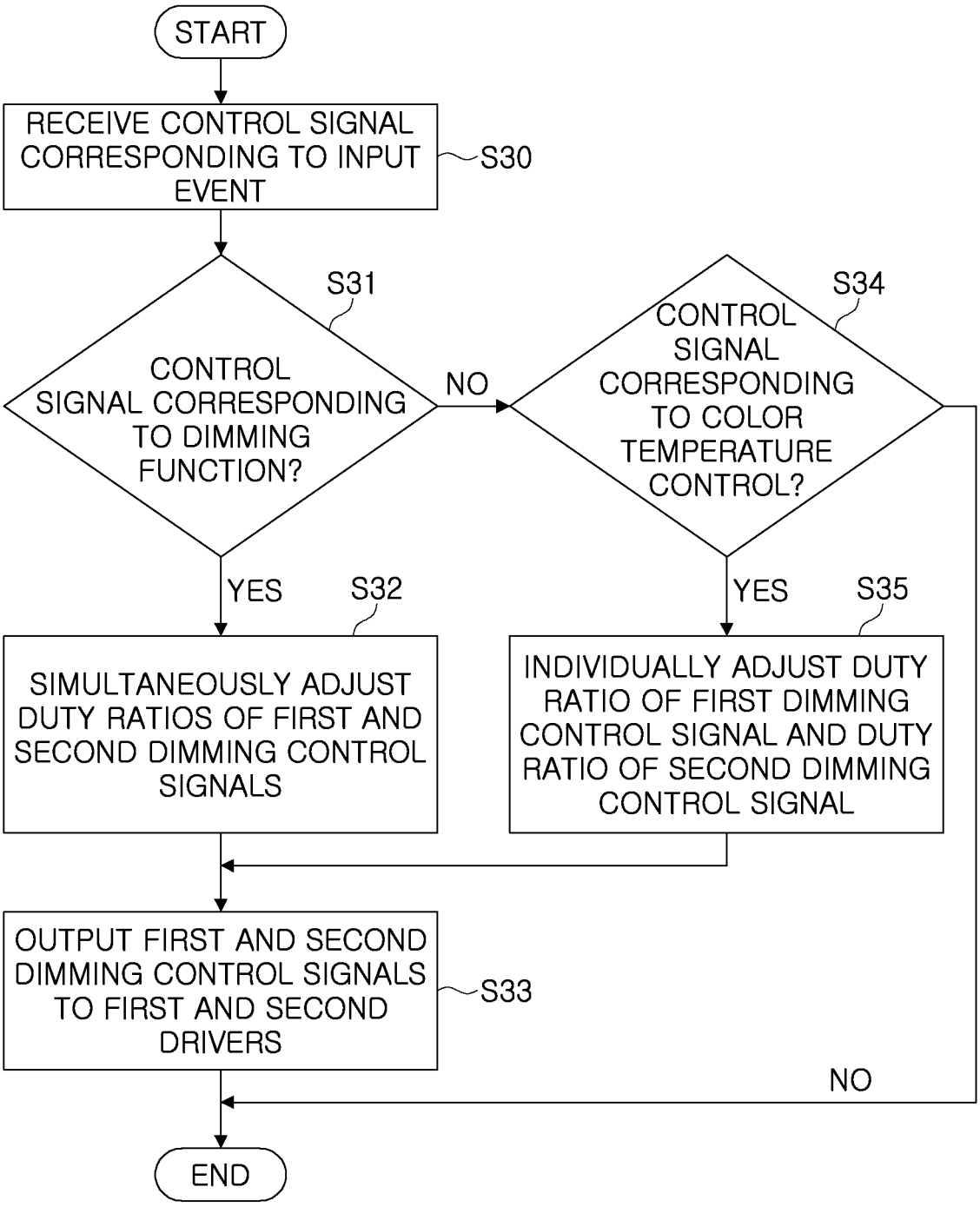

FIGS. 8 to 10 are diagrams illustrating operation of an LED driving device according to example embodiments.

Referring first to FIG. 8, the operation of the LED driving device according to an example embodiment may include receiving a control signal corresponding to an input event (S10). An input event may be an event in which a switch, an input panel, or the like is manipulated. The switch element and/or the control circuit may generate a control signal corresponding to the input event and transmit the control signal to the microcontroller of the LED driving device.

Upon receiving the control signal, the microcontroller may generate a dimming control signal corresponding to the control signal (S11). For example, the voltage level of the control signal, the waveform of the control signal, and the like may vary according to an input event. The microcontroller may be configured to differently output the dimming control signal according to characteristics, such as a voltage level, a waveform, or the like, of the received control signal. For example, the microcontroller may change the duty ratio of the dimming control signal according to a voltage level, a waveform, or the like of the control signal.

The microcontroller may output the dimming control signal to the driver (S12). As described above, the driver may be connected to an output terminal of an LED string in which a plurality of LEDs are connected in series, and an output terminal of the rectifier may be connected to an input terminal of the LED string. By operating the driver based on the dimming control signal received from the microcontroller, the LED current flowing through the LED string may vary, and as a result, the brightness of the light output by the LED string may be controlled. When the light source has a plurality of LED strings that output light of different color temperatures, by adjusting the LED current flowing through each of the plurality of LED strings, the color temperature of the light output by the light source may be controlled.

The microcontroller may store the setting of the dimming control signal in the internal memory (S13). For example, the microcontroller may store settings such as a frequency and a duty ratio of the dimming control signal generated in operation S11 in an internal memory. The setting of the dimming control signal stored in the internal memory may be maintained until a control signal corresponding to another input event is received. For example, when the power of the LED driving device is turned off and then turned on again, the microcontroller may generate a dimming control signal according to the settings stored in the internal memory and output the signal to the driver. Therefore, when the power is turned on again, the LED driving device may operate in the same manner as before the power was turned off.

Next, referring to FIG. 9, the operation of the LED driving device according to an example embodiment may include receiving, for example by the microcontroller, a control signal corresponding to an input event (S20). As described above, an input event may be an event in which a switch and/or an input panel is manipulated, and when an input event occurs, a corresponding control signal may be input to the microcontroller.

In the example embodiment illustrated in FIG. 9, the microcontroller may determine the number of times the control signal has been received (S21). For example, the microcontroller may count and store the number of times the control signal has been received in the internal memory, and when a control signal corresponding to the same input event is continuously received, it may be determined whether the number of consecutive receptions of the control signal is equal to or greater than a predetermined reference number (S22).

As a result of the determination in operation S22, when the number of times the control signal has been received is equal to or greater than the reference number, the microcontroller may initialize the dimming control signal (S23). Initializing the dimming control signal may indicate that the dimming control signal is set to a default dimming control signal, which may for example be set at the point in time when a lighting device including an LED driving device is installed.

On the other hand, when it is determined in operation S22 that the number of times the control signal has been received is less than the reference number, the microcontroller may generate a dimming control signal according to the control signal and output the generated signal to the driver (S24, S25). For example, the dimming control signal generated by the microcontroller in operation S24 may vary depending on the number of times the microcontroller receives the control signal in addition to the voltage level and waveform of the control signal received by the microcontroller in operation S20.

For example, when the microcontroller receives a control signal corresponding to an input event in which the switch is briefly turned on, the microcontroller may increase the duty ratio of the dimming control signal in proportion to the number of times the control signal has been received. In this case, the brightness of the light output from the lighting device may gradually increase in proportion to the number of times the switch is manipulated. In addition, when the number of times the control signal has been received exceeds the number of times required to increase the brightness of the light to a maximum value thereof, the microcontroller may stop the output of the dimming control signal, or decrease the duty ratio of the dimming control signal. The brightness of the light output from the lighting device may be reduced to a minimum value. In this case, the number of times the switch is briefly turned on, and may control the light output from the lighting device to be set to a required brightness.

Referring to FIG. 10, the operation of the LED driving device according to an example embodiment may include receiving, for example by the microcontroller, a control signal corresponding to an input event (S30). As described above, the input event may be an event in which a switch and/or an input panel is manipulated, and when an input event occurs, a control signal corresponding thereto may be input to the microcontroller.

In an example embodiment described with reference to FIG. 10, the LED driving device may drive a light source having a first LED string and a second LED string outputting light of different color temperatures. The first LED string and the second LED string may be connected to each other in parallel, the first LED string may be connected to the first driver, and the second LED string may be connected to the second driver.

The microcontroller may determine whether the received control signal corresponds to the dimming function (S31). When it is determined that the control signal corresponds to the dimming function, the microcontroller may simultaneously adjust and output the duty ratios of the first dimming control signal output to the first driver and the second dimming control signal output to the second driver (S32 and S33). For example, when the control signal corresponds to a dimming function of reducing the brightness of light, the microcontroller may simultaneously decrease duty ratios of the respective first dimming control signal and the second dimming control signal. On the other hand, when the control signal corresponds to the dimming function of increasing the brightness of light, the microcontroller may simultaneously increase the duty ratios of the respective first dimming control signal and the second dimming control signal.

As a result of the determination in operation S31, when it is determined that the control signal does not correspond to the dimming function, the microcontroller may determine whether the control signal corresponds to the color temperature control function (S34). When it is determined in operation S34 that the control signal corresponds to the color temperature control function, the microcontroller may individually adjust the duty ratio of the first dimming control signal and the duty ratio of the second dimming control signal based on the control signal, and may output the signals (S35, S33).

In an example embodiment, the first LED string may output warm white-based light, and the second LED string may output cool white-based light. As an example, the color temperature of the light output by the first LED string may be 2700K, and the light output by the second LED string may be 6000K.

When an input event is generated to reduce the color temperature of the light output from the lighting device, the microcontroller may increase a duty ratio of the first dimming control signal according to the control signal and reduce the duty ratio of the second dimming control signal. Accordingly, the color temperature of light output from the lighting device may change to be close to warm white. On the other hand, when an input event is generated to increase the color temperature of the light output from the lighting device, the microcontroller may decrease the duty ratio of the first dimming control signal and increase the duty ratio of the second dimming control signal. Accordingly, the color temperature of light output from the lighting device may be closer to cool white.

When it is determined in operation S34 that the control signal does not correspond to color temperature control, the microcontroller may not adjust either the first dimming control signal or the second dimming control signal, as the microcontroller determines that an erroneous input event has occurred. Also, in the example embodiment illustrated in FIG. 10, the microcontroller may first determine whether the control signal instructs color temperature adjustment, and later determine whether it corresponds to the dimming function.

Figure 11:
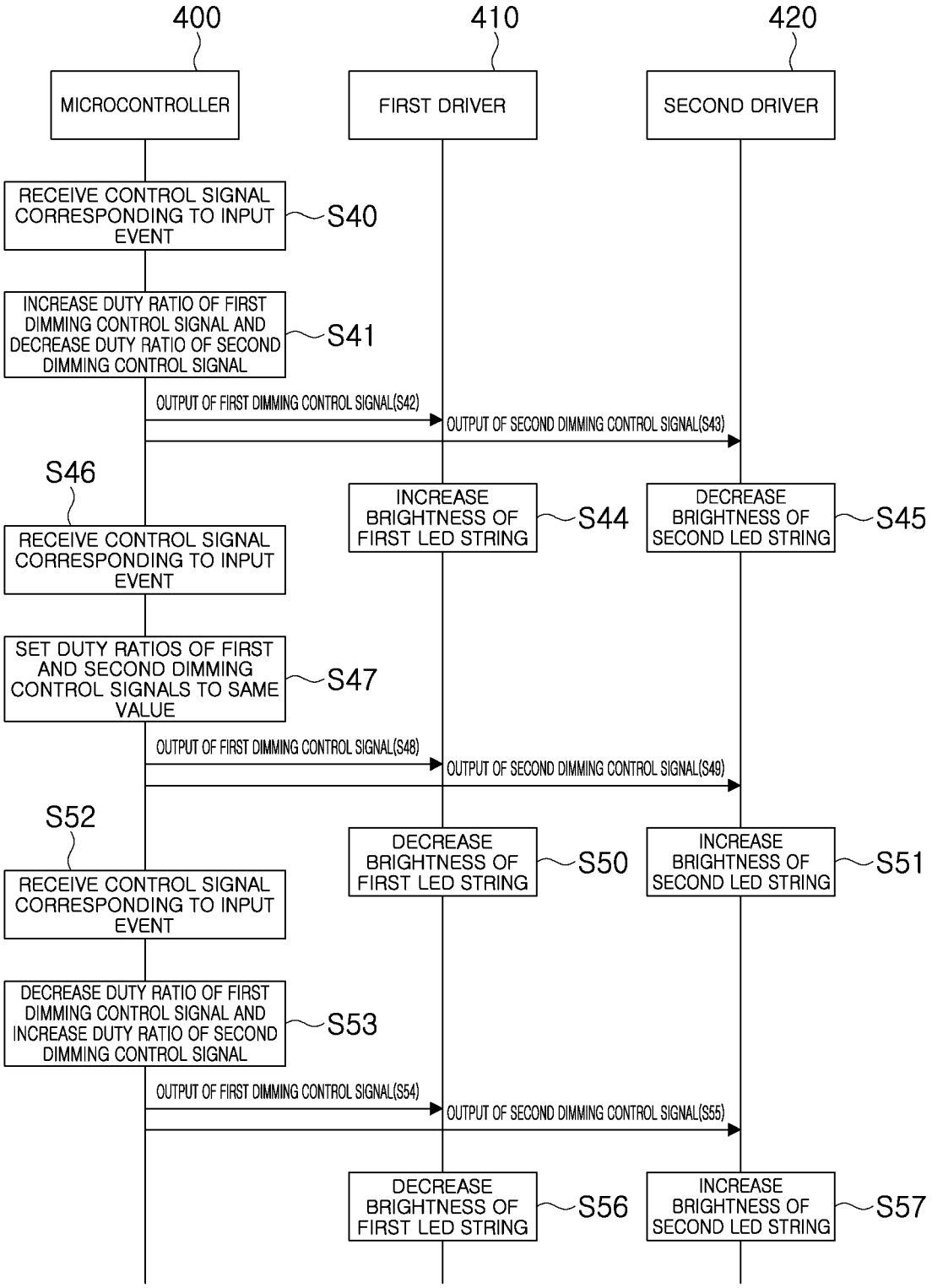
FIG. 11 is a diagram illustrating operation of an LED driving device according to an example embodiment.

FIG. 11 is a diagram illustrating operation of the LED driving device according to an example embodiment.

Referring to FIG. 11, the LED driving device according to an example embodiment may include a microcontroller 400, a first driver 410, a second driver 420, and the like. The first driver 410 may be connected to a first LED string that outputs light of a first color temperature, and the second driver 420 may be connected to a second LED string that outputs light of a second color temperature. However, according to example embodiments, the number of drivers and the number of LED strings may be variously modified.

The microcontroller 400 may receive a control signal corresponding to the input event (S40). As described above, the input event may be an event in which a switch and/or an input panel is manipulated, and when an input event occurs, a control signal corresponding thereto may be input to the microcontroller.

Referring to FIG. 11, the microcontroller 400 receiving the control signal may increase the duty ratio of the first dimming control signal and decrease the duty ratio of the second dimming control signal (S41). Thereafter, the microcontroller 400 may output the first dimming control signal and the second dimming control signal to the first driver 410 and the second driver 420, respectively (S42 and S43). Accordingly, the brightness of the first LED string may increase (S44), the brightness of the second LED string may decrease (S45), and the color temperature of light output from the lighting device may approach the first color temperature.

Thereafter, the microcontroller 400 may again receive a control signal corresponding to the input event (S46). For example, the input event occurring in operation S46 may be the same as the input event occurring in operation S40. Accordingly, the control signal received by the microcontroller in operation S46 may be the same signal as the control signal received in operation S40.

However, in contrast to the first time the control signal is received, in based on the control signal being received twice, the microcontroller 400 may set the duty ratio of the first dimming control signal and the second dimming control signal to the same value (S47). When the duty ratio of the first dimming control signal is set to be greater than the duty ratio of the second dimming control signal by the previous operation, the microcontroller may decrease the duty ratio of the first dimming control signal and increase the duty ratio of the second dimming control signal in operation S47.

Thereafter, the microcontroller 400 may output the first dimming control signal and the second dimming control signal to the first driver 410 and the second driver 420, respectively (S48 and S49). Accordingly, the brightness of the first LED string decreases (S50), the brightness of the second LED string increases (S51), and the color temperature of the light output from the lighting device may approach an intermediate value between the first color temperature and the second color temperature.

Referring to FIG. 11, the microcontroller 400 may once again receive a control signal corresponding to an input event (S52). The input event occurring in operation S52 may also be the same as the input event occurring in operations S40 and S46. Accordingly, the control signal received by the microcontroller in operation S52 may be the same as the control signal received by the microcontroller in operations S40 and S46.

The microcontroller 400 may decrease the duty ratio of the first dimming control signal and increase the duty ratio of the second dimming control signal based on the same control signal being received three times (S53). By the previous operation S47, the duty ratio of the first dimming control signal and the duty ratio of the second dimming control signal are set to the same value, and the duty ratio of the first dimming control signal may be set to be greater than the duty ratio of the second dimming control signal by the microcontroller in operation S53.

The microcontroller 400 may output the first dimming control signal and the second dimming control signal to the first driver 410 and the second driver 420, respectively (S54 and S55). Accordingly, the brightness of the first LED string decreases (S56), the brightness of the second LED string increases (S57), and the color temperature of the light output from the lighting device may approach the second color temperature.

The example embodiment described with reference to FIG. 11 provides one of various scenarios that may be implemented with the LED driving device and the lighting device including the same according to an example embodiment. Scenarios for adjusting the brightness and/or color temperature of light output from the lighting device may vary depending on example embodiments. Hereinafter, various scenarios that may be implemented in example embodiments will be described with reference to FIGS. 12 to 22.

Figure 12:
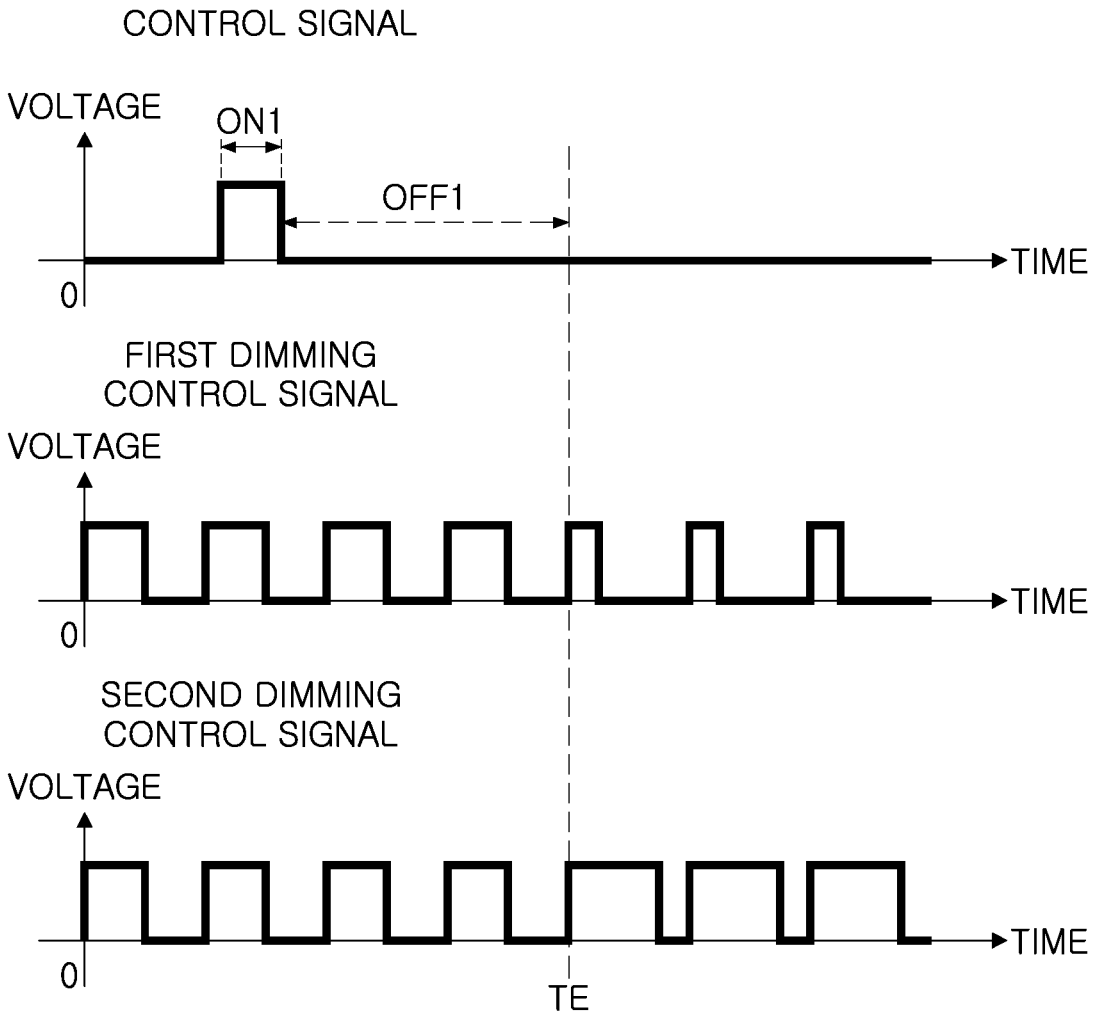
FIGS. 12 and 13 are diagrams illustrating a dimming function of a lighting device according to an example embodiment.
Figure 13:
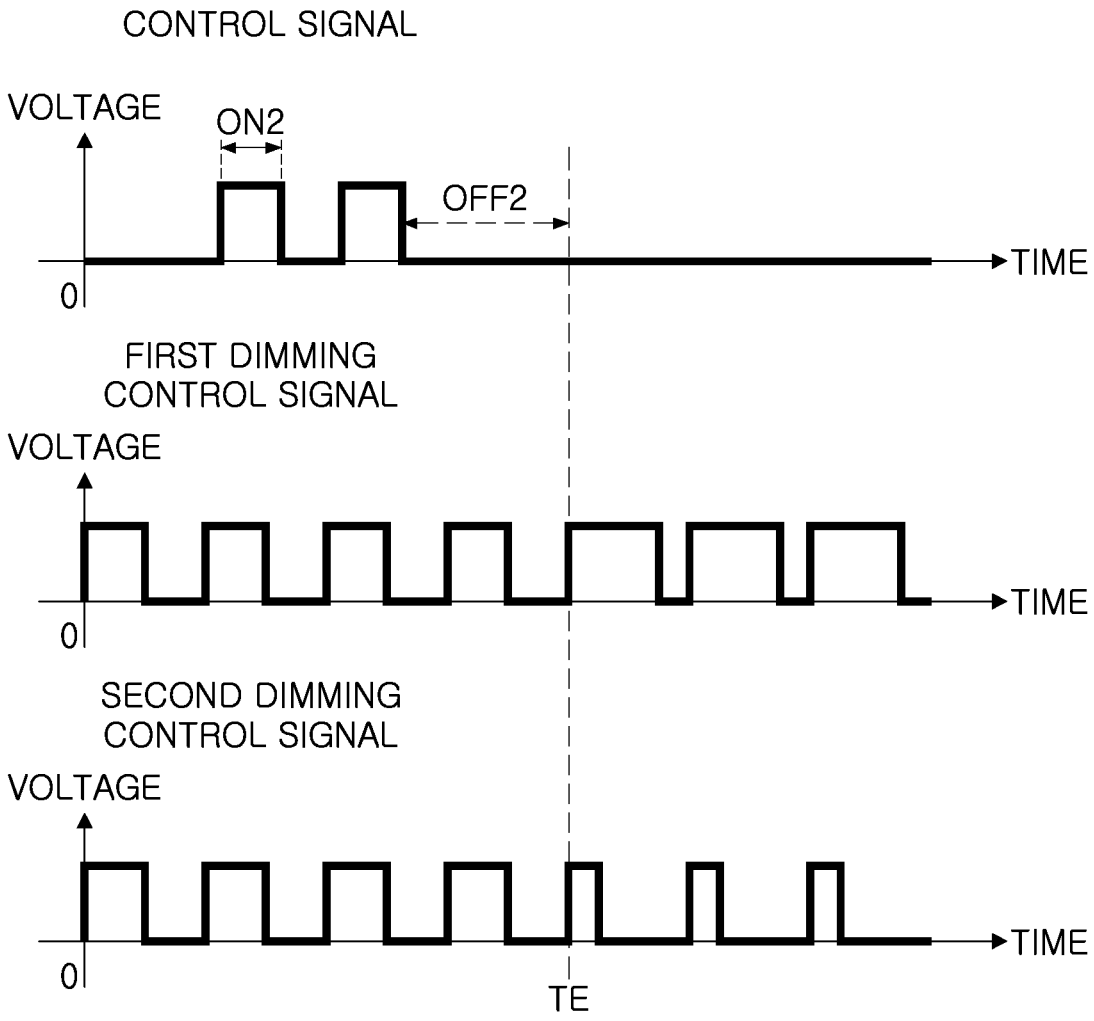

FIGS. 12 and 13 are diagrams illustrating a dimming function of a lighting device according to an example embodiment.

In an example embodiment described with reference to FIGS. 12 and 13, the lighting device may include a light source and an LED driving device, and the light source may include a first LED string and a second LED string. The first LED string may output light of a first color temperature and may be controlled by a first driver, and the second LED string may output light of a second color temperature and may be controlled by a second driver. The first driver and the second driver may be controlled by the first dimming control signal and the second dimming control signal output by the microcontroller.

Referring first to FIG. 12, a control signal may be generated by an input event, and the voltage waveform of the control signal may have a short first turn-on time ON1 and a long first turn-off time OFF1. The microcontroller of the LED driving device may respectively output the first dimming control signal and the second dimming control signal having the same duty ratio to the first driver and the second driver, before an end point (TE) when the reception of the control signal is terminated. In the example embodiment illustrated in FIG. 12, each of the first dimming control signal and the second dimming control signal may have a duty ratio of 50% before the end time TE.

The microcontroller may adjust a duty ratio of each of the first dimming control signal and the second dimming control signal after the end time TE according to the control signal. In the example embodiment illustrated in FIG. 12, the microcontroller may decrease the duty ratio of the first dimming control signal and increase the duty ratio of the second dimming control signal according to the control signal. Accordingly, the color temperature of the light output from the lighting device after the end time point TE may be close to the second color temperature.

Next, referring to FIG. 13, the voltage waveform of the control signal generated by the input event may have two short second turn-on times ON2 and a relatively long second turn-off time OFF2. As discussed above with respect to FIG. 12, before the end point (TE) when the reception of the control signal is terminated, a first dimming control signal and a second dimming control signal having the same duty ratio may be input to the first driver and the second driver, respectively.

The microcontroller may adjust a duty ratio of each of the first dimming control signal and the second dimming control signal after the end time TE according to the control signal. In the example embodiment illustrated in FIG. 13, the microcontroller may increase the duty ratio of the first dimming control signal and decrease the duty ratio of the second dimming control signal according to the control signal. Accordingly, the color temperature of the light output from the lighting device after the end time point TE may be close to the first color temperature.

FIGS. 14 to 18 are diagrams illustrating an operation of a lighting device according to an example embodiment.

In an example embodiment described with reference to FIGS. 14 to 18, the lighting device may include a light source and an LED driving device, and the light source may include a first LED string and a second LED string. The first LED string may output light of a first color temperature and may be controlled by a first driver, and the second LED string may output light of a second color temperature and may be controlled by a second driver. Each of the first driver and the second driver may be controlled by the first dimming control signal and the second dimming control signal output by the microcontroller.

Figure 14:
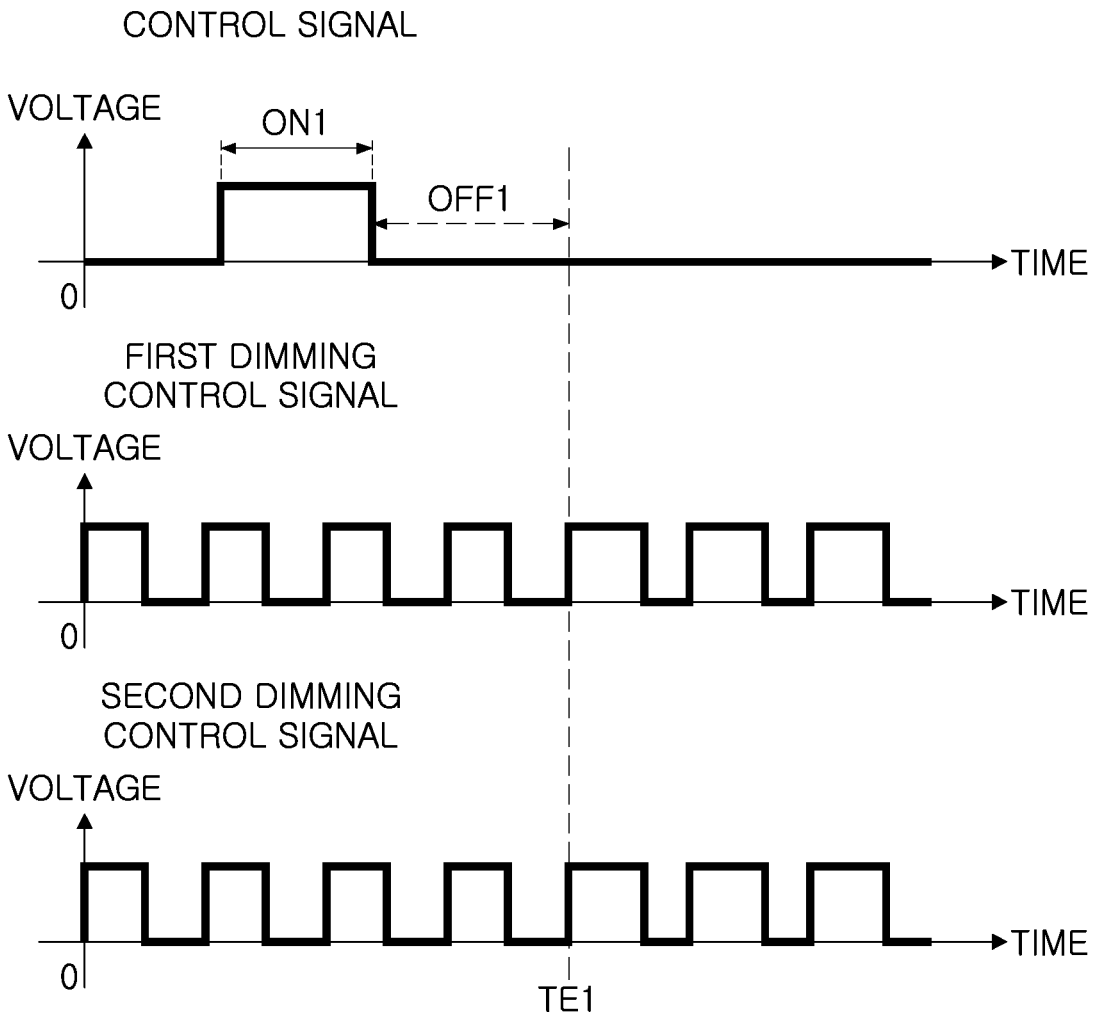
FIGS. 14 to 18 are diagrams illustrating operation of a lighting device according to an example embodiment.

Referring first to FIG. 14, a voltage waveform of a control signal generated by an input event may have a first turn-on time ON1 and a first turn-off time OFF1. The first turn-on time ON1 may be shorter than the first turn-off time OFF1. The microcontroller of the LED driving device may respectively output a first dimming control signal and a second dimming control signal having a duty ratio according to an initial setting value to the first driver and the second driver, before the end point (TE) when the reception of the control signal is terminated. In the example embodiment illustrated in FIG. 14, the duty ratio according to the initial setting value may be 50%.

The microcontroller may adjust a duty ratio of each of the first dimming control signal and the second dimming control signal after the end time TE according to the control signal. 12, and the microcontroller may simultaneously increase the duty ratios of the first dimming control signal and the second dimming control signal according to the control signal. Therefore, the color temperature of the light output from the lighting device may not change after the first end time TE1 when the reception of the control signal is completed, and the brightness of the light may be increased. For example, in the example embodiment illustrated in FIG. 14, a duty ratio of each of the first dimming control signal and the second dimming control signal after the first end time point TE1 may be 60%.

The first turn-on time ON1 in the example embodiment illustrated in FIG. 14 may be longer than the first turn-on time ON1 in the example embodiment described with reference to FIG. 12. Accordingly, the microcontroller may separately execute a dimming function of controlling the brightness of light and a function of adjusting a color temperature of light by referring to the length of the turn-on time of the control signal.

Figure 15:
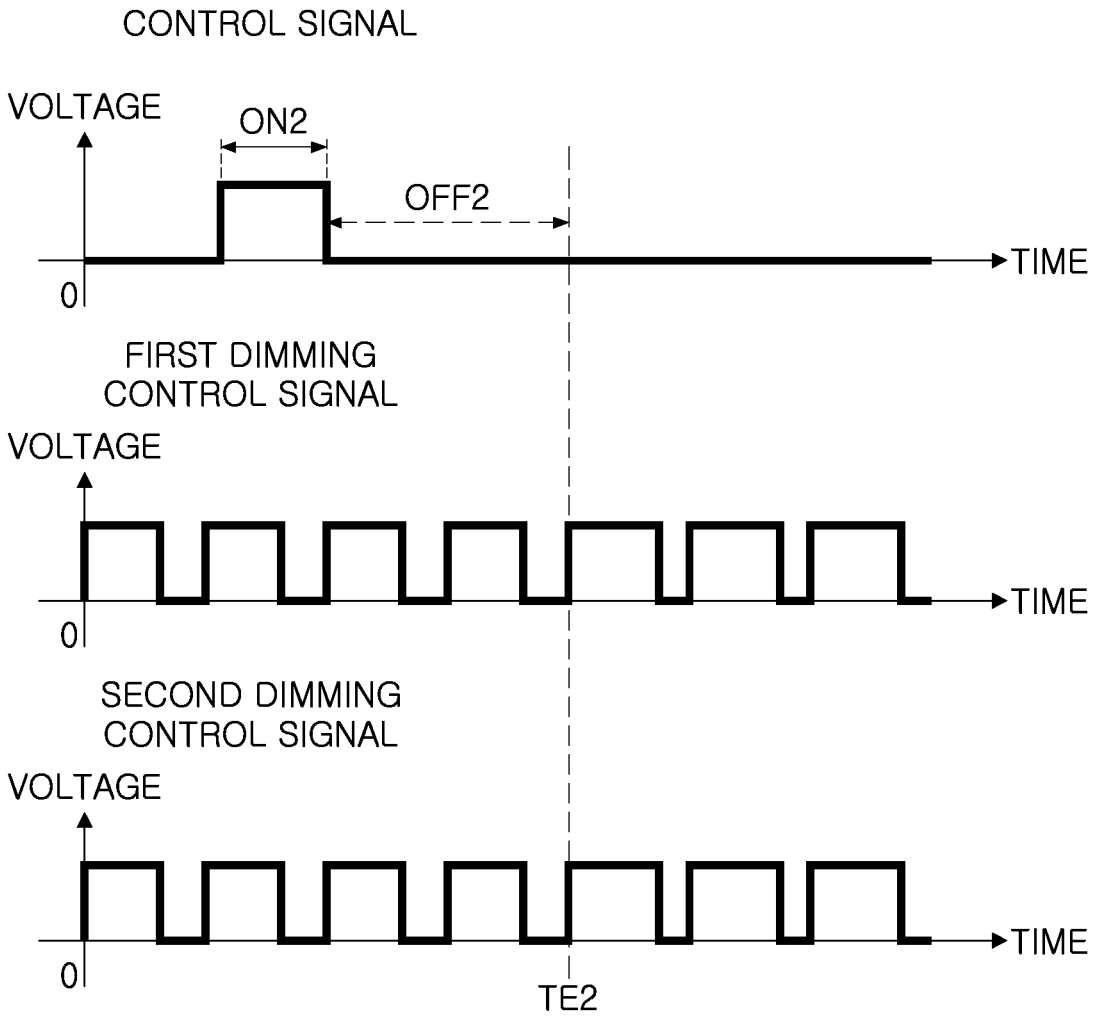

Next, referring to FIG. 15, the microcontroller may receive a control signal of a waveform having a second turn-on time (ON2) and a second turn-off time (OFF2) longer than the second turn-on time (ON2). For example, the control signal received by the microcontroller in the example embodiment illustrated in FIG. 15 may be the same as the control signal in the example embodiment illustrated in FIG. 14 above.

Accordingly, as described above with reference to FIG. 14, the microcontroller may simultaneously increase the duty ratios of the respective first dimming control signal and the second dimming control signal after the end time TE according to the control signal. Accordingly, the brightness of the light output from the lighting device after the second end time TE2 when the reception of the control signal is completed may increase more than in the example embodiment described with reference to FIG. 14. For example, in the example embodiment illustrated in FIG. 15, a duty ratio of each of the first dimming control signal and the second dimming control signal after the second end time TE2 may be 75%.

Figure 16:
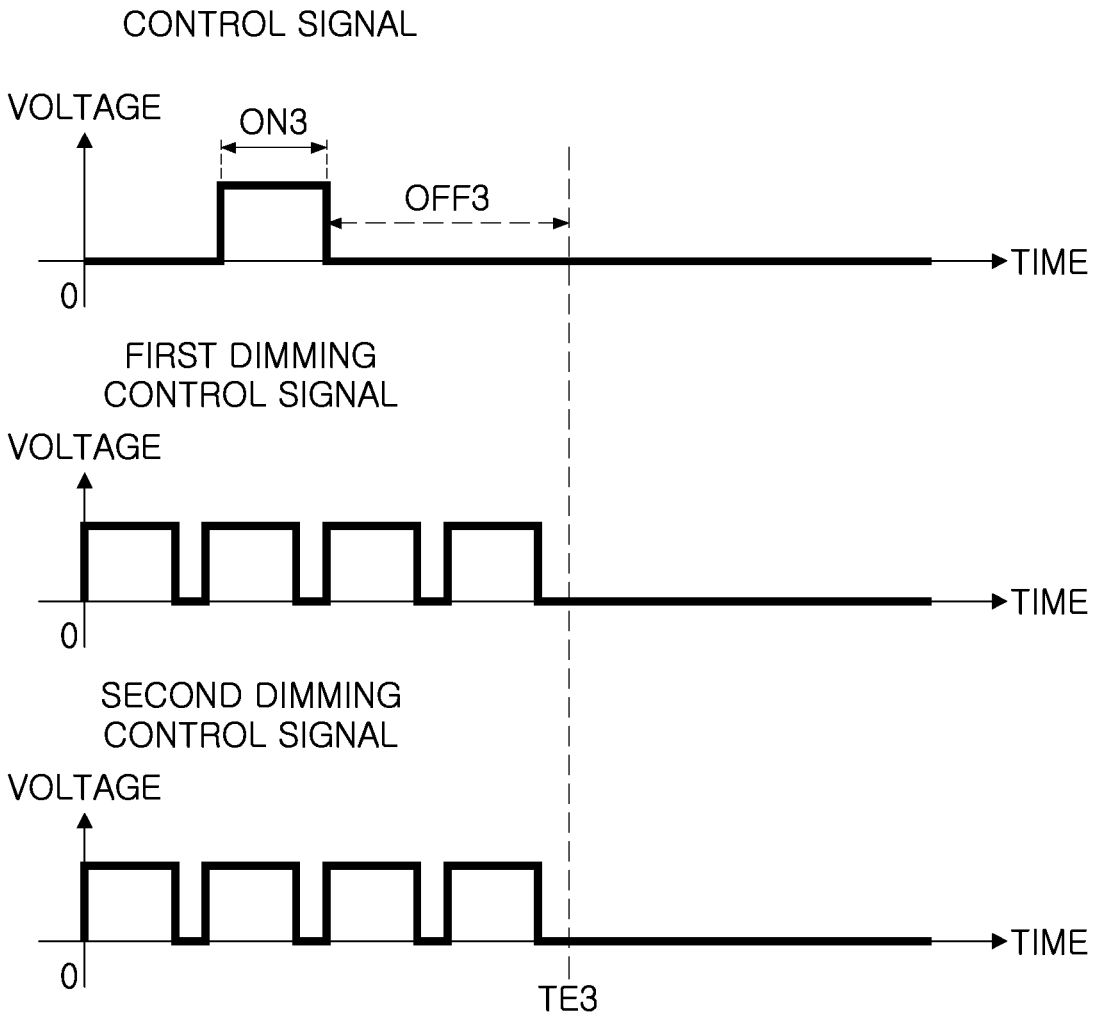

Referring to FIG. 16, the microcontroller may receive a control signal of a waveform having a third turn-on time ON3 and a third turn-off time OFF3 longer than the third turn-on time ON3. For example, the control signal received by the microcontroller in the example embodiment illustrated in FIG. 16 may be the same as the control signal according to the example embodiments illustrated in FIGS. 14 and 15 above.

However, in contrast to the operations described with reference to FIGS. 14 and 15, the microcontroller may convert the voltage waveforms of the first dimming control signal and the second dimming control signal to a low level after the end time TE according to the control signal. Accordingly, after a third end time point TE3, the LED strings may be turned off to not output light.

In an example embodiment, the microcontroller may turn off the LED strings and store final settings of each of the first dimming control signal and the second dimming control signal in the internal memory. In the example embodiment illustrated in FIG. 16, a duty ratio of 75% set to each of the first dimming control signal and the second dimming control signal before the LED strings are turned off may be stored as a final setting value in the internal memory of the microcontroller.

Figure 17:
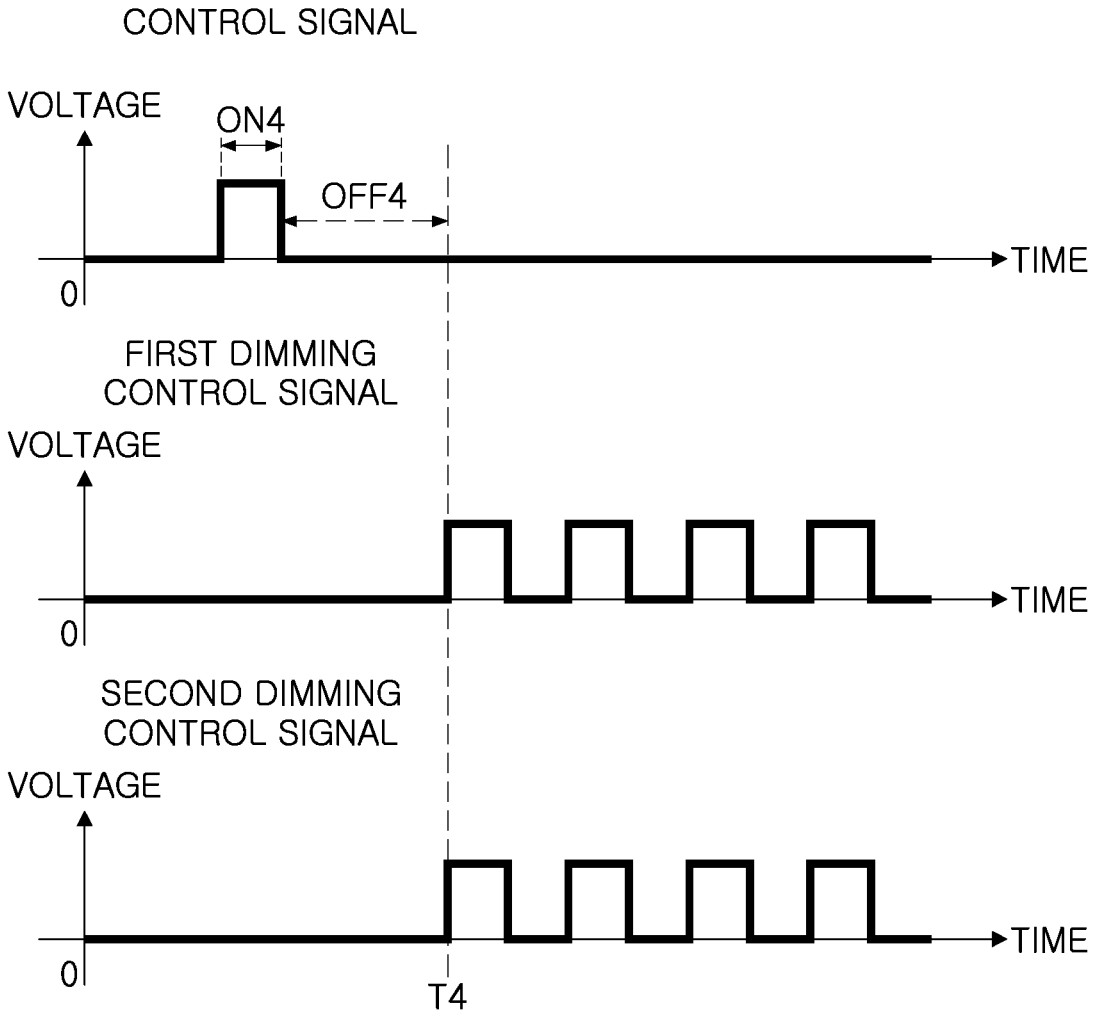

Referring to FIG. 17, the microcontroller may receive a control signal in a state in which the LED strings are turned off. The voltage waveform of the control signal received by the microcontroller may have a fourth turn-on time ON4 and a fourth turn-off time OFF4. For example, the fourth turn-on time ON4 may be shorter than each of the turn-on times ON1-ON3 according to the example embodiments described above with reference to FIGS. 14 to 16.

When it is determined that the reception of the control signal is finished, the microcontroller may control the first dimming control signal and the second dimming control signal such that the first LED string and the second LED string are turned on again according to the control signal after the fourth end time TE4. In the example embodiment illustrated in FIG. 17, the microcontroller may output the first dimming control signal and the second dimming control signal having the initial setting values described above with reference to FIG. 14. Accordingly, the duty ratio of each of the first dimming control signal and the second dimming control signal may be set to 50%.

Figure 18:
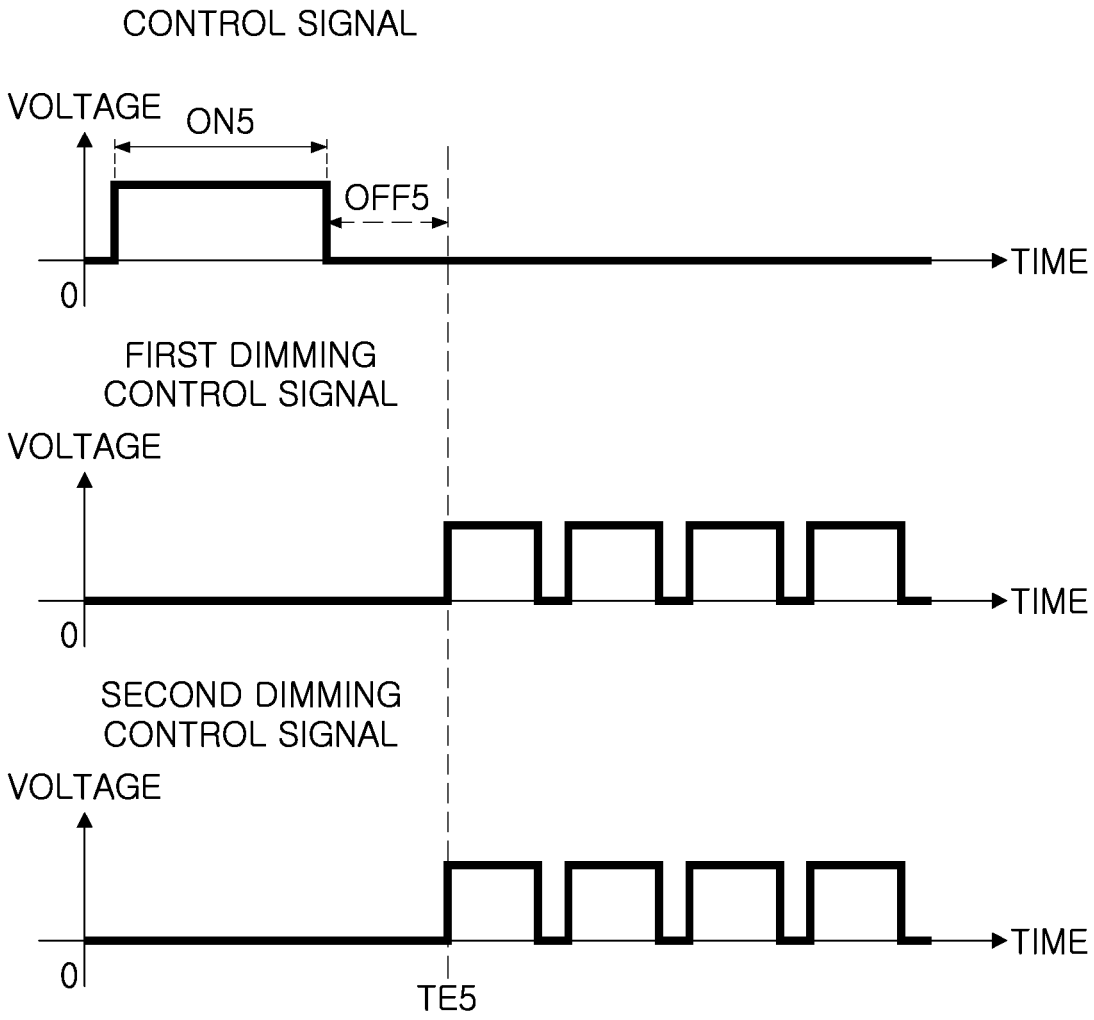

Referring to FIG. 18, similar to the example embodiment described with reference to FIG. 17 above, the microcontroller may receive a control signal in a state in which the LED strings are turned off. The voltage waveform of the control signal received by the microcontroller may have a fifth turn-on time ON5 and a fifth turn-off time OFF5. The fifth turn-on time ON5 may be longer than each of the turn-on times ON1-ON4 according to the example embodiments described above with reference to FIGS. 14 to 17.

As illustrated in FIG. 18, the microcontroller receiving the control signal having a relatively long fifth turn-on time ON5 may output the first dimming control signal and the second dimming control signal by reading the final set value stored in the internal memory. Therefore, as described above with reference to FIG. 16, the microcontroller may output the first dimming control signal and the second dimming control signal having a duty ratio of 75% at the fifth end time (TE5) by referring to a final setting value stored in the internal memory. As described with reference to FIGS. 17 and 18, the brightness of a lighting device that is turned on again may be set differently according to a type of an input event generated in a situation in which the lighting device is turned off.

FIGS. 19 to 22 are diagrams illustrating an operation of a lighting device according to an example embodiment.

In an example embodiment described with reference to FIGS. 19 to 22, the configuration of the lighting device may be similar to the example embodiments described with reference to FIGS. 12 to 18. The light source of the lighting device may include a first LED string and a second LED string that output light of different color temperatures. The first LED string and the second LED string may be independently controlled by the first driver and the second driver.

Figure 19:
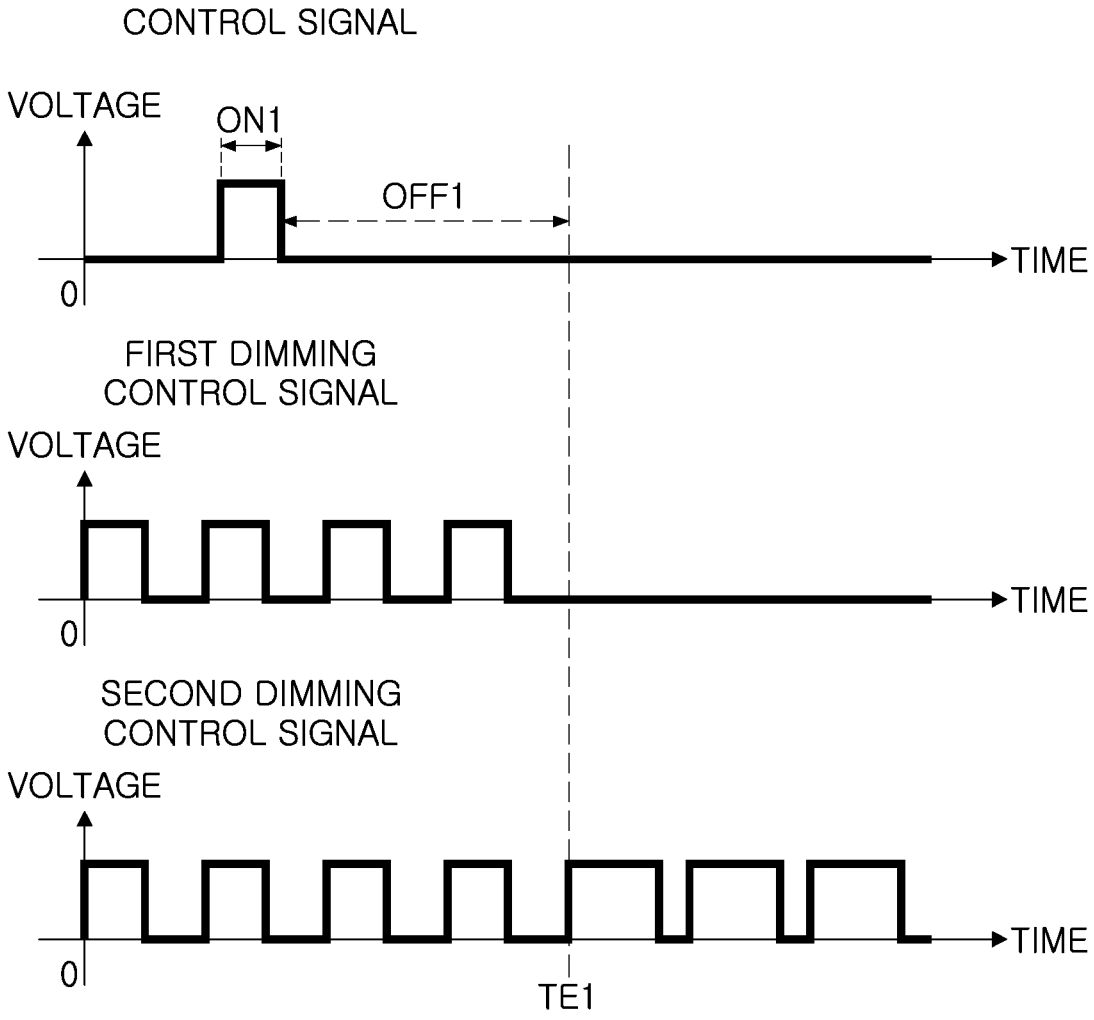
FIGS. 19 to 22 are diagrams illustrating operation of a lighting device according to an example embodiment.

Referring first to FIG. 19, while the first driver and the second driver operate by the first dimming control signal and the second dimming control signal each having a duty ratio of 50%, respectively, the microcontroller that controls the first driver and the second driver may receive the control signal. The control signal may have a first turn-on time ON1 and a first turn-off time OFF1, and the first turn-off time OFF1 may be longer than the first turn-on time ON1.

At the first end time TE1 when the reception of the control signal is completed, the microcontroller may adjust the first dimming control signal and the second dimming control signal according to the control signal. Referring to FIG. 19, the microcontroller may change the duty ratio of the first dimming control signal to 0% and increase the duty ratio of the second dimming control signal to 75% according to the control signal. Accordingly, after the first end time TE1, the color temperature of the light output from the lighting device may be changed to the second color temperature of the light output from the second LED string.

Figure 20:
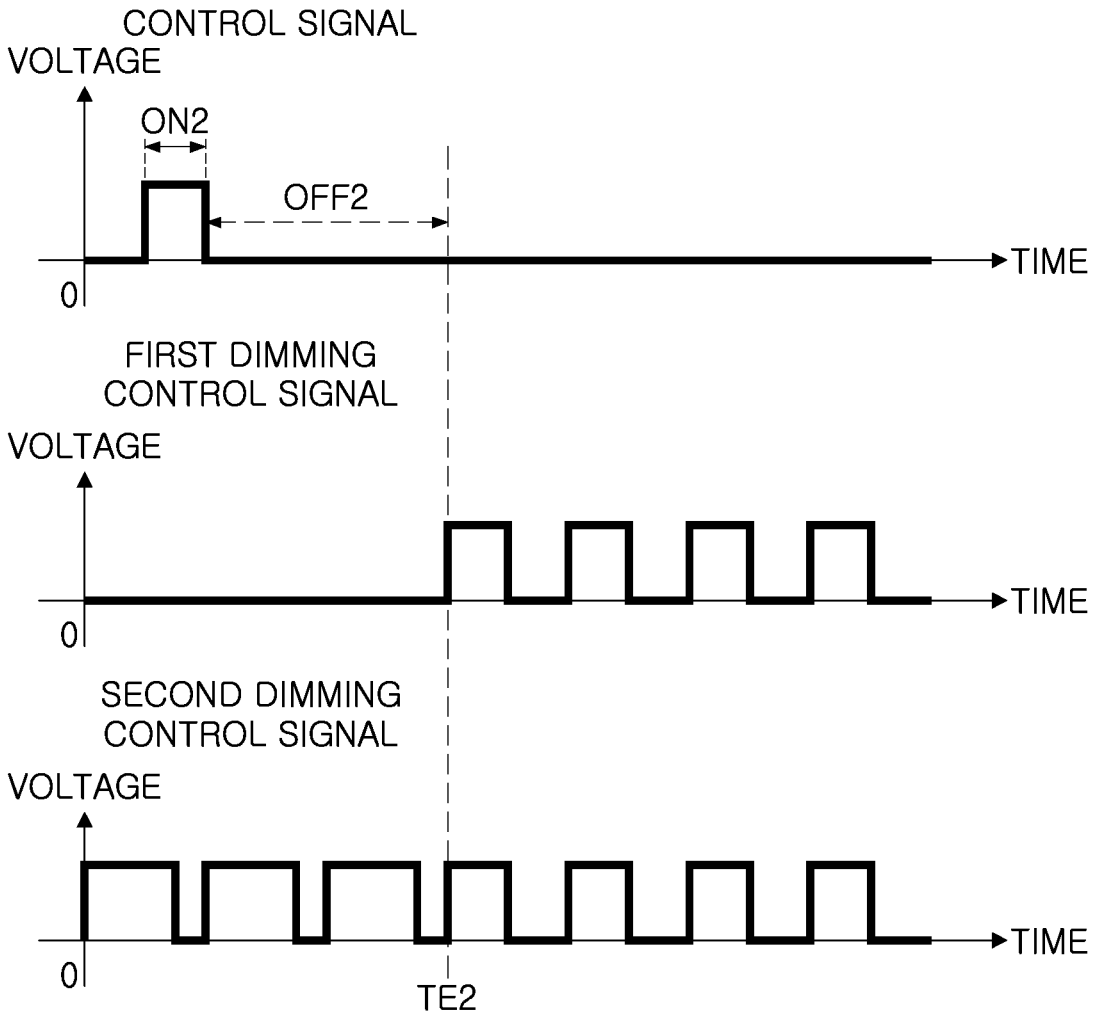

On the other hand, the microcontroller may receive the control signal again after the first end time TE1. Referring to FIG. 20, the control signal received by the microcontroller after the first end time TE1 may have a waveform similar to the control signal according to the example embodiment described with reference to FIG. 19. After the second end time TE2 at which the reception of the control signal is completed, the microcontroller may change the duty ratio of each of the first dimming control signal and the second dimming control signal to 50%. Accordingly, the color temperature of the light output from the lighting device after the second end time TE2 may be the same as the color temperature of the light output from the lighting device before the first end time TE1.

Figure 21:
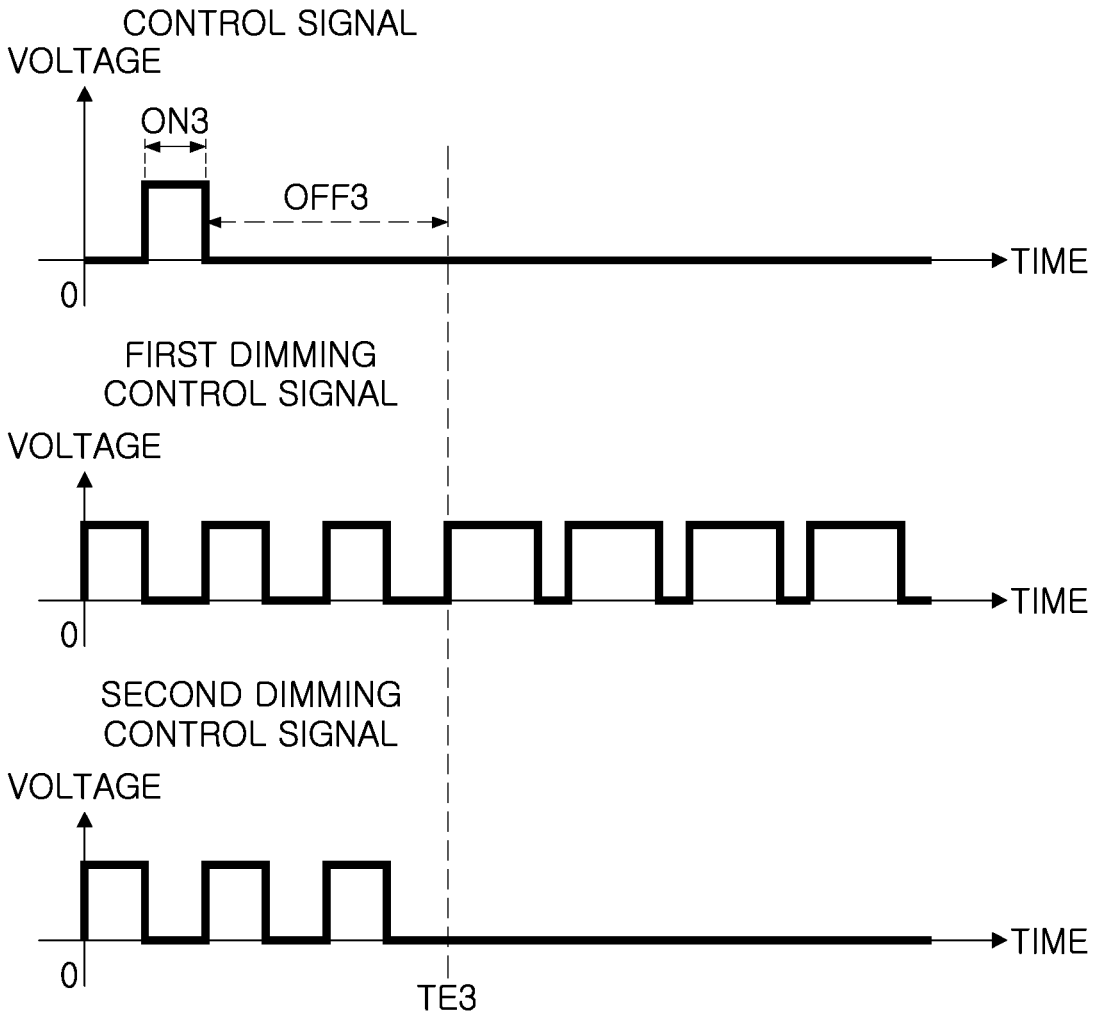

Referring to FIG. 21, after the second end time TE2, the microcontroller may receive the control signal again a third time. The third control signal received by the microcontroller may also be similar to the control signal according to the example embodiment described above with reference to FIG. 19.

After the third end point TE3 when the reception of the control signal is completed, the microcontroller may change the duty ratio of the first dimming control signal to 75% and may set the duty ratio of the second dimming control signal to 0%. Accordingly, the color temperature of the light output from the lighting device after the third end point TE3 may be changed to the first color temperature of the light output from the first LED string.

Figure 22:
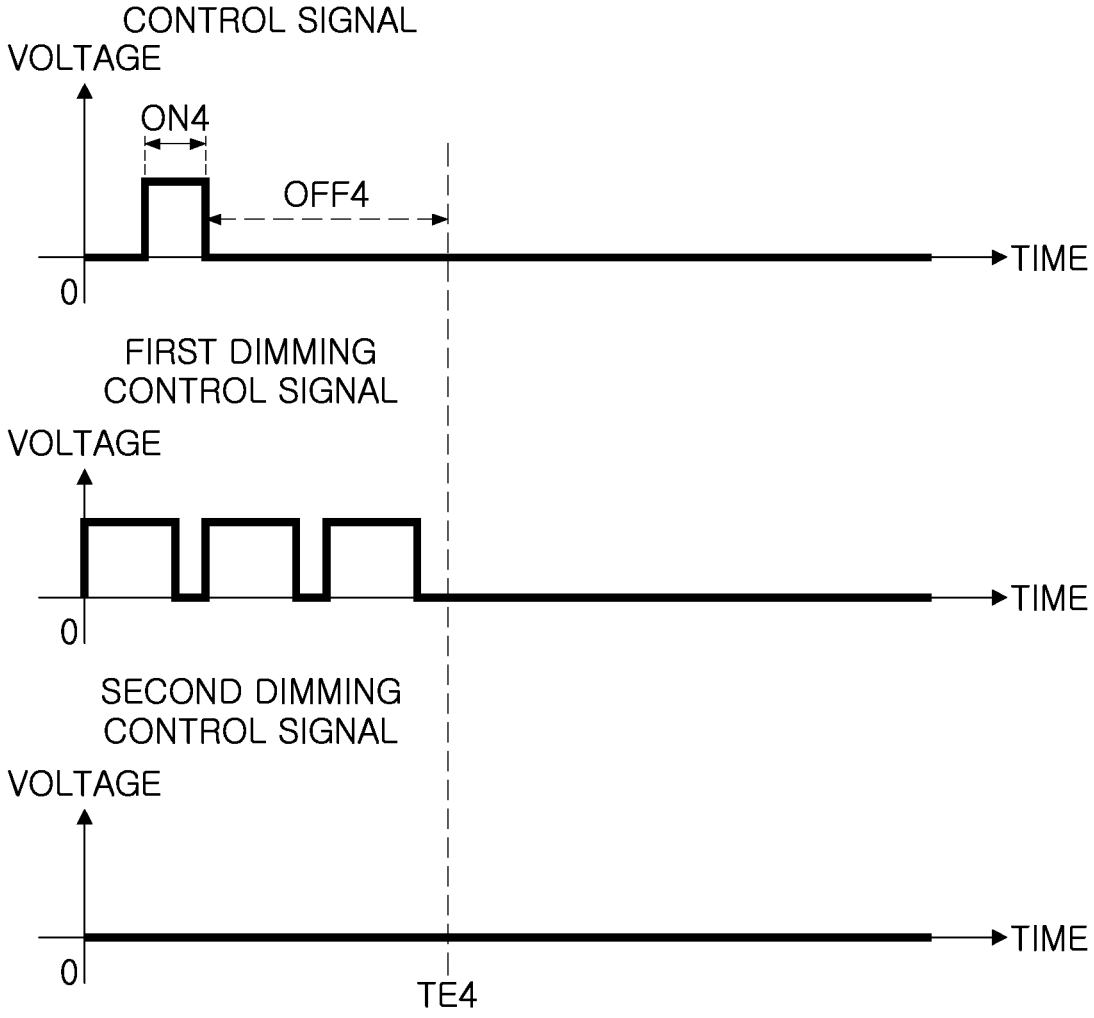

Next, referring to FIG. 22, the microcontroller may receive the same control signal a fourth time after the third end time TE3. The fourth control signal received by the microcontroller may also be similar to the control signal according to the example embodiment described above with reference to FIG. 19.

After the fourth end time TE4 when the reception of the control signal is completed, the microcontroller may set the duty ratio of the first dimming control signal and the second dimming control signal to 0%. Therefore, after the fourth end time point TE4, all LEDs included in the light source of the lighting device are turned off, and the LED drive device may enter the standby state.

As described above, the example embodiments described with reference to FIGS. 12 to 22 are provided to describe example scenarios that may be implemented in the lighting device according to an example embodiment. The LED driving device and lighting device according to an example embodiment may include a switch element and/or a control circuit that determines a control signal input to a control terminal of a microcontroller. Also, the voltage level and/or waveform of the control signal generated by the switch element and/or the control circuit may vary according to an input event.

The microcontroller may be pre-programmed to adjust the first dimming control signal and the second dimming control signal according to the voltage level and/or the waveform of the control signal. Also, as described with reference to FIGS. 12 to 22, the microcontroller may adjust the first dimming control signal and the second dimming control signal based on the voltage level and/or waveform of the currently received control signal as well as the history of the previously received control signal. For example, the reception history of the previously received control signal may be stored in the internal memory of the microcontroller.

In addition, in an example embodiment, the microcontroller may also adjust the first dimming control signal and the second dimming control signal by referring to the duty ratio and/or voltage level of the first dimming control signal and the second dimming control signal being output to the first driver and the second driver at a point in time when the control signal has been received, together with the control signal. For example, as described with reference to FIG. 16, when the control signal is received in a state where the duty ratio of each of the first dimming control signal and the second dimming control signal is 75%, the microcontroller may turn off the LED strings by reducing both the duty ratios of the first dimming control signal and the second dimming control signal to 0%.

Accordingly, the LED driving device and the lighting device according to an example embodiment may provide various functions, for example, a dimming function and a color temperature control function with a simple configuration. Input events that may be generated in an input device such as a switch element and/or an input panel, and a function of a lighting device matching the input event may be provided to the user in the form of a manual.

Figure 23:
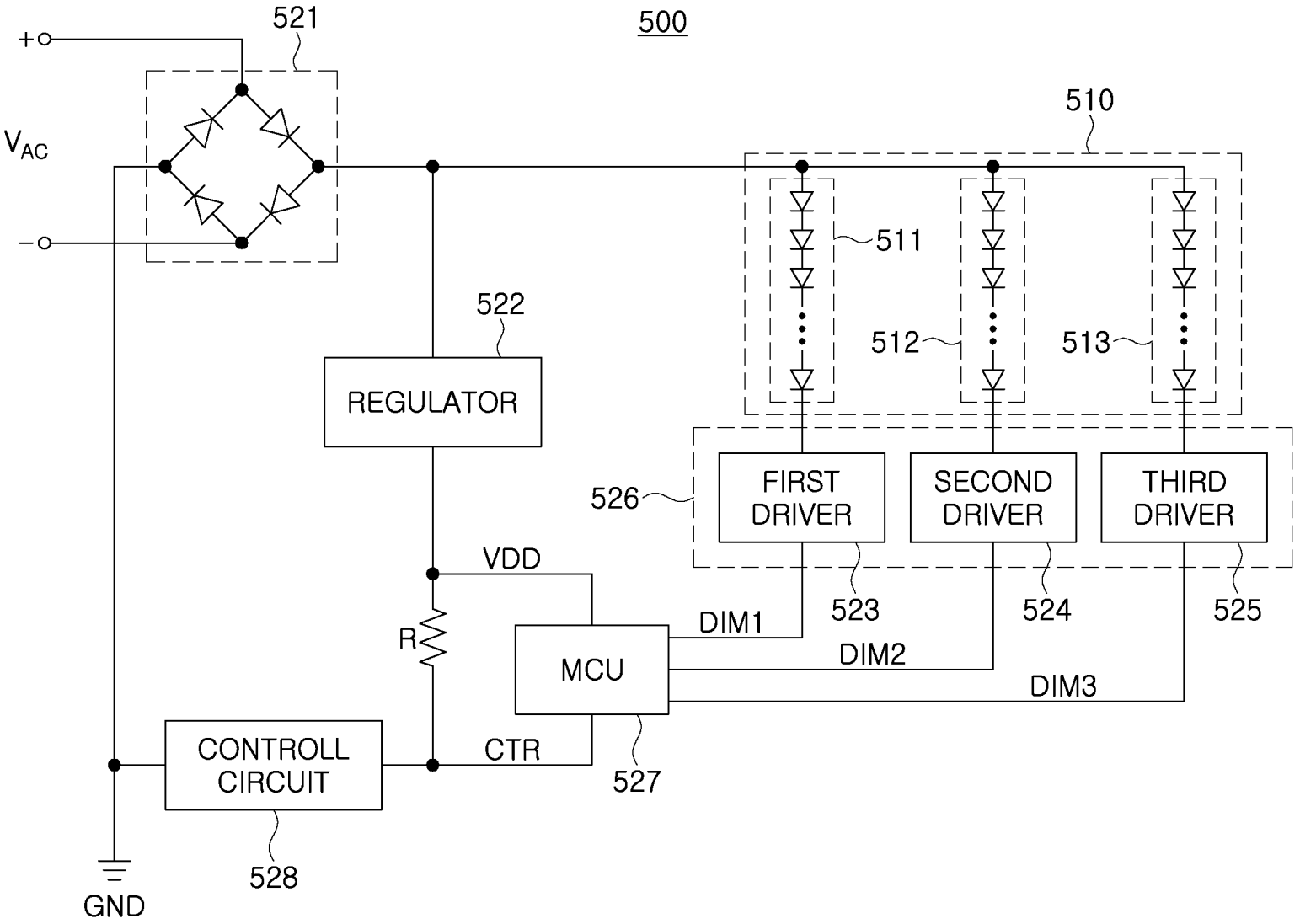
FIG. 23 is a diagram schematically illustrating a lighting device according to an example embodiment.

FIG. 23 is a diagram schematically illustrating a lighting device according to an example embodiment.

Referring to FIG. 23, a lighting device 500 according to an example embodiment may include a light source 510 and an LED driving device. The LED driving device may include a rectifier 521, a regulator 522, a driving unit 526, a microcontroller 527, and a control circuit 528. The driving unit 526 may include first to third drivers 523-525.

The light source 510 may include first to third LED strings 511-513 that output light of different colors. For example, the first to third LED strings 511-513 may respectively output red, green, and blue light. In the driving unit 526, the first driver 523 may be connected to the first LED string 511, the second driver 524 may be connected to the second LED string 512, and the third driver 525 may be connected to the third LED string 513.

The microcontroller 527 may output the first to third dimming control signals DIM1-DIM3 to control the first to third drivers 523-525 and to adjust the light output from the light source 510. Similar to the above-described example embodiments, the microcontroller 527 may simultaneously increase or decrease the duty ratios of the respective first to third dimming control signals DIM1 to DIM3 to increase or decrease the brightness of the light output from the light source 510. Also, the microcontroller 527 may individually adjust the duty ratio of each of the first to third dimming control signals DIM1 to DIM3 to change the color of the light output from the light source 510.

The microcontroller 527 may adjust respective duty ratios of the first to third dimming control signals DIM1 to DIM3 according to the control signal CTR provided by the control circuit 528. As described above, the control circuit 528 may be connected to an input panel or switch that may be directly manipulated, generate a control signal (CTR) according to an input event generated from an input panel or switch, and may provide the generated control signal to the microcontroller 527. When the first to third LED strings 511-513 respectively output red, green, and blue light, the first to third LED strings 511-513 may be controlled based on manipulation of the input panel such that the light source 510 outputs light of various colors.

As set forth above, according to an example embodiment, in an LED driving device operating an LED by receiving the output of a rectifier without a converter circuit, a dimming function to control brightness and a function to vary color temperature may be implemented with a relatively simple configuration. The user may adjust the brightness and color temperature of light output by the LED by using a switch or a control circuit included in the LED driving device. Accordingly, a lighting device having improved convenience and fewer components may be implemented.

While aspects of example embodiments have been illustrated and described above, it will be understood that modifications and variations could be made without departing from the scope of the appended claims.

What is claimed is:

1. A light emitting diode (LED) driving device comprising:

a rectifier configured to rectify alternating current (AC) power to generate a rectified voltage, wherein the rectifier is directly connected to an input node of a light source comprising a plurality of LEDs;

a regulator configured to output a direct current (DC) power supply voltage using the rectified voltage;

a microcontroller comprising a control terminal and a power terminal, wherein the microcontroller is configured to generate a dimming control signal based on a voltage input, receive the DC power supply voltage through the power terminal and output the dimming control signal through the control terminal;

a driver configured to control an LED current to flow through the plurality of LEDs based on the dimming control signal; and a switch connected between a control node and a ground node, wherein an output terminal of the regulator and the control terminal are connected to the control node.

2. The LED driving device of claim 1, wherein the switch comprises a contact switch.

3. The LED driving device of claim 1, wherein the microcontroller is further configured to control the dimming control signal based on any one or any combination of a turn-on time of the switch and a turn-off time of the switch.

4. The LED driving device of claim 3, wherein the dimming control signal is a pulse width modulation (PWM) signal, and wherein the microcontroller is further configured to control a duty ratio of the dimming control signal, based on any one or any combination of the turn-on time and the turn-off time.

5. The LED driving device of claim 3, wherein the dimming control signal is an analog voltage signal, and wherein the microcontroller is further configured to control a voltage level of the dimming control signal, based on any one or any combination of the turn-on time and the turn-off time.

6. The LED driving device of claim 1, wherein the driver comprises a current control terminal connected to an output node of the light source.

7. The LED driving device of claim 1, wherein the driver comprises a first driver connected to an output terminal of a first light source configured to output light having a first color temperature, and a second driver connected to an output terminal of a second light source configured to output light having a second color temperature different from the first color temperature, and wherein the microcontroller is further configured to output a first dimming control signal to the first driver and a second dimming control signal to the second driver.

8. The LED driving device of claim 7, wherein the microcontroller is further configured to independently control each of the first dimming control signal and the second dimming control signal, based on any one or any combination of a turn-on time of the switch and a turn-off time of the switch.

9. The LED driving device of claim 1, wherein the dimming control signal is a pulse width modulation (PWM) signal, and wherein the microcontroller is further configured to control the dimming control signal such that pulses of the dimming control signal have a plurality of predetermined widths, based on an input event comprising a turn-on of the switch and a turn-off of the switch.

10. The LED driving device of claim 1, wherein the microcontroller comprises an internal memory, and wherein the microcontroller is further configured to store a setting of the dimming control signal in the internal memory based on the DC power supply voltage being cut off.

11. A lighting device comprising:

a rectifier configured to rectify alternating current (AC) power to output a rectified voltage;

a regulator configured to output a direct current (DC) power supply voltage, using the rectified voltage;

a first light emitting diode (LED) string comprising a plurality of first LEDs configured to output light of a first color temperature, wherein the first LED string is connected to an output terminal of the rectifier;

a second LED string comprising a plurality of second LEDs configured to output light of a second color temperature, wherein the second LED string is connected to the output terminal of the rectifier, and the first LED string in parallel;

a microcontroller comprising a control terminal, wherein the microcontroller is configured to generate a first dimming control signal and a second dimming control signal, based on a voltage input to the control terminal and the DC power supply voltage;

a first driver configured to control a first LED current to flow through the first LED string, based on the first dimming control signal;

a second driver configured to control a second LED current to flow through the second LED string, based on the second dimming control signal; and a control circuit configured to generate a control signal based on an input, and to output the control signal to the control terminal.

12. The lighting device of claim 11, wherein the control circuit is connected between a ground node and a control node, wherein the control node is connected to an output terminal of the regulator and the control terminal, and wherein the control circuit comprises a contact switch.

13. The lighting device of claim 11, wherein the control circuit is connected to an input panel configured to receive the input.

14. The lighting device of claim 11, wherein the first dimming control signal is a first pulse width modulation (PWM) signal and the second dimming control signal is a second PWM signal, and wherein the microcontroller is further configured to independently control a first duty ratio of the first dimming control signal and a second duty ratio of the second dimming control signal.

15. The lighting device of claim 11, further comprising:

a third LED string connected to the first LED string and the second LED string in parallel; and a third driver connected to an output terminal of the third LED string, wherein the third driver is configured to control a third LED current to flow through the third LED string based on a third dimming control signal.

16. The lighting device of claim 15, wherein the microcontroller is further configured to independently control each of the first dimming control signal, the second dimming control signal, and the third dimming control signal.

17. The lighting device of claim 11, wherein the microcontroller is further configured to control the first dimming control signal and the second dimming control signal, based on an input event indicated by one or any combination of a voltage level of the control signal, a waveform of the control signal, and a timing of the control signal.

18. The lighting device of claim 17, wherein the microcontroller is further configured to control the first dimming control signal and the second dimming control signal based on a number of times a first input event is indicated by the control signal.

19. The lighting device of claim 17, wherein the microcontroller is further configured to:

control the first dimming control signal and the second dimming control signal to change an intensity ratio of the first LED current to the second LED current, based on the control signal indicating a first input event; and control the first dimming control signal and the second dimming control signal to change control the first dimming control signal and the second dimming control signal to change an entirety of intensity of the first LED current and the second LED current while maintaining the intensity ratio, based on the control signal indicating a second input event.

20. A lighting device comprising:

a rectifier configured to rectify alternating current (AC) power and output a rectified voltage;

a regulator configured to output a direct current (DC) power supply voltage using the rectified voltage;

a first light emitting diode (LED) string comprising a plurality of first LEDs configured to output light having a first color temperature, wherein the first LED string is connected to an output terminal of the rectifier;

a second LED string comprising a plurality of second LEDs configured to output light having a second color temperature, wherein the second LED string is connected to the output terminal of the rectifier, and the first LED string in parallel;

a microcontroller comprising a control terminal, wherein the microcontroller is configured to generate a first dimming control signal and a second dimming control signal based on the DC power supply voltage and any one or any combination of a voltage level and a waveform of a control signal input to the control terminal;

a first driver configured to control brightness of the first LED string based on the first dimming control signal; and a second driver configured to control brightness of the second LED string based on the second dimming control signal, wherein the microcontroller comprises an internal memory, and is configured to adjust the first dimming control signal and the second dimming control signal based on a history of the control signal stored in the internal memory.

* * * * *